US011852128B2

(12) United States Patent
Tanaka et al.

(10) Patent No.: US 11,852,128 B2
(45) Date of Patent: Dec. 26, 2023

(54) PIEZOELECTRIC PUMP ARRANGEMENT HAVING A VALVE DIAPHRAGM AND PRESSURE VESSEL

(71) Applicant: Murata Manufacturing Co., Ltd., Kyoto (JP)

(72) Inventors: Nobuhira Tanaka, Kyoto (JP); Kenjiro Okaguchi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 613 days.

(21) Appl. No.: 16/942,165

(22) Filed: Jul. 29, 2020

(65) Prior Publication Data

US 2020/0355179 A1 Nov. 12, 2020

Related U.S. Application Data

(63) Continuation of application No. PCT/JP2019/002665, filed on Jan. 28, 2019.

(30) Foreign Application Priority Data

Jan. 30, 2018 (JP) ..... 2018-013504

(51) Int. Cl.
*F04B 43/04* (2006.01)
*F04B 45/047* (2006.01)
*F04B 39/10* (2006.01)

(52) U.S. Cl.
CPC ..... *F04B 43/046* (2013.01); *F04B 45/047* (2013.01); *F04B 39/10* (2013.01)

(58) Field of Classification Search
CPC ..... F04B 43/04; F04B 43/046; F04B 45/047; F04B 39/10
See application file for complete search history.

(56) References Cited

U.S. PATENT DOCUMENTS 4,889,132 A * 12/1989 Hutcheson ..... A61B 5/02208 600/496
9,723,999 B2 * 8/2017 Yamashita ..... A61B 5/02255
(Continued)

FOREIGN PATENT DOCUMENTS

CN 107076137 A 8/2017
JP 2007198165 A 8/2007
(Continued)

OTHER PUBLICATIONS

International Search Report issued in Application No. PCT/JP2019/002665, dated Apr. 23, 2019.
(Continued)

*Primary Examiner* — Nathan C Zollinger
(74) *Attorney, Agent, or Firm* — Pearne & Gordon LLP

(57) ABSTRACT

A fluid control apparatus includes a piezoelectric pump, a pressure vessel, an input unit, a drive control unit, and a driving circuit. The piezoelectric pump has a pump chamber whose volume fluctuates due to displacement of a piezoelectric element, a valve chamber communicated with the pump chamber and has a valve diaphragm, a pump chamber opening that allows the pump chamber to be communicated with an outside of the pump chamber, and a valve chamber opening that allows the valve chamber communicate with an outside of the valve chamber. The pressure vessel is communicated with the valve chamber. The driving circuit drives the piezoelectric element upon application of a driving power-supply voltage from the drive control unit. The drive control unit adjusts the driving power-supply voltage or a driving current corresponding to the driving power-supply voltage in accordance with a vibration state of the valve diaphragm.

19 Claims, 18 Drawing Sheets

(56) References Cited

U.S. PATENT DOCUMENTS

| | | | | |
|---|---|---|---|---|
| 2015/0150470 | A1* | 6/2015 | Sano | A61B 5/0225 600/490 |
| 2017/0112697 | A1 | 4/2017 | Tanaka | |
| 2017/0138357 | A1* | 5/2017 | Kondo | F04B 53/10 |
| 2017/0218948 | A1* | 8/2017 | Chang | F04B 49/20 |
| 2017/0218949 | A1 | 8/2017 | Yokoi et al. | |
| 2018/0051686 | A1* | 2/2018 | Tanaka | F04B 35/045 |
| 2018/0093057 | A1* | 4/2018 | Higashiyama | A61M 16/044 |

FOREIGN PATENT DOCUMENTS

| | | | |
|---|---|---|---|
| JP | 2009203822 | A | 9/2009 |
| JP | 2016200067 | A | 12/2016 |
| JP | 2017072140 | A | 4/2017 |
| WO | 2016/006677 | A1 | 1/2016 |

OTHER PUBLICATIONS

Written Opinion issued in Application No. PCT/JP2019/002665 dated Apr. 23, 2019.

* cited by examiner

PIEZOELECTRIC PUMP ARRANGEMENT HAVING A VALVE DIAPHRAGM AND PRESSURE VESSEL

This is a continuation of International Application No. PCT/JP2019/002665 filed on Jan. 28, 2019 which claims priority from Japanese Patent Application No. 2018-013504 filed on Jan. 30, 2018. The contents of these applications are incorporated herein by reference in their entireties.

BACKGROUND

Technical Field

The present disclosure relates to a fluid control apparatus including a piezoelectric pump provided with a valve for rectification.

Patent Document 1 describes a fluid control apparatus including a piezoelectric pump. The piezoelectric pump includes a valve part for rectification. The valve part includes a valve top plate, a valve bottom plate, a side wall plate, and a valve chamber surrounded by the valve top plate, the valve bottom plate, and the side wall plate. The valve chamber is communicated with an outside through a through-hole provided in the valve top plate and is communicated with a discharge hole of the piezoelectric pump through a through-hole provided in the valve bottom plate.

A valve diaphragm is disposed in the valve chamber to partition the valve chamber into a region on a valve top plate side and a region on a valve bottom plate side.

When fluid (e.g., air) flows from the piezoelectric pump into the valve chamber, the valve diaphragm moves toward the top plate. This allows the through-hole on the valve bottom plate side and the through-hole on the valve top plate side to be communicated with each other, thereby discharging the fluid from the piezoelectric pump into the outside.

Meanwhile, when fluid flows from the outside into the valve chamber, the valve diaphragm moves toward the valve bottom plate and blocks the through-hole of the valve bottom plate to prevent the fluid from flowing back to the piezoelectric pump.

Patent Document 1: Japanese Unexamined Patent Application Publication No. 2017-72140

BRIEF SUMMARY

However, the valve diaphragm is not always remaining still at a certain position but is vibrating because of the aforementioned movement. Due to the vibration, the valve diaphragm repeatedly collides with the valve top plate or the valve bottom plate.

This damages the valve diaphragm. Repetition of such damage breaks the valve diaphragm in some cases.

The present disclosure reduces damage on a valve diaphragm.

A fluid control apparatus according to the present disclosure includes a piezoelectric pump, a pressure vessel, an input unit, a drive control unit, and a driving circuit. The piezoelectric pump has a pump chamber whose volume fluctuates due to displacement of a piezoelectric element, a valve chamber that is communicated with the pump chamber and has a valve diaphragm, a pump chamber opening that allows the pump chamber to be communicated with an outside of the pump chamber, and a valve chamber opening that allows the valve chamber to be communicated with an outside of the valve chamber. The pressure vessel is provided outside the valve chamber and is communicated with the valve chamber through the valve chamber opening. The input unit receives a power-supply voltage from a power supply. The drive control unit generates and a driving power-supply voltage from the power-supply voltage supplied from the input unit and outputs the driving power-supply voltage. The driving circuit drives the piezoelectric element upon application of the driving power-supply voltage from the drive control unit. The drive control unit adjusts the driving power-supply voltage or a driving current corresponding to the driving power-supply voltage in accordance with a vibration state of the valve diaphragm.

According to this configuration, the driving power-supply voltage or the driving current is adjusted in accordance with a vibration state of the valve diaphragm. This adjusts a state of collision of the valve diaphragm with a wall that constitutes the valve chamber.

The fluid control apparatus according to the present disclosure is configured such that the drive control unit adjusts the driving power-supply voltage or the driving current in accordance with a differential pressure between an atmospheric pressure and a pressure of the pressure vessel.

According to this configuration, a vibration state of the valve diaphragm varies depending on the differential pressure, and based on this, the driving power-supply voltage or the driving current is adjusted in accordance with the vibration state of the valve diaphragm. This adjusts a state of collision of the valve diaphragm with a wall that constitutes the valve chamber.

The fluid control apparatus according to the present disclosure can be configured such that the drive control unit increases the driving power-supply voltage or the driving current in accordance with an increase of the differential pressure. According to this configuration, collision of the valve diaphragm with a wall of the valve chamber on a side opposite to the pump chamber is reduced.

The fluid control apparatus according to the present disclosure can be configured, for example, such that the drive control unit continuously increases the driving power-supply voltage or the driving current. According to this configuration, driving efficiency is improved while reducing collision with the valve diaphragm.

The fluid control apparatus according to the present disclosure can be configured, for example, such that the drive control unit increases the driving power-supply voltage or the driving current in a stepwise fashion. According to this configuration, the control is simplified while reducing collision with the valve diaphragm.

The fluid control apparatus according to the present disclosure can be configured, for example, such that the drive control unit performs control for increasing the driving power-supply voltage one time during driving. According to this configuration, the control is further simplified.

The fluid control apparatus according to the present disclosure can be configured, for example, such that the drive control unit performs control so that the driving power-supply voltage or the driving current at a first differential pressure larger than a minimum value of the differential pressure becomes higher than the driving power-supply voltage or the driving current at the minimum value. According to this configuration, the control based on the differential pressure is performed with more certainty.

The fluid control apparatus according to the present disclosure can be configured, for example, such that a difference between the minimum value of the differential pressure and the first differential pressure is approximately 0.5 times as large as a difference between the minimum value of the differential pressure and a maximum value of the differential pressure. According to this configuration, the control based on the differential pressure is performed with more certainty, and driving efficiency is relatively improved.

The fluid control apparatus according to the present disclosure can be configured, for example, such that the drive control unit decreases the driving power-supply voltage or the driving current in accordance with an increase of the differential pressure. According to this configuration, collision of the valve diaphragm with a wall of the valve chamber on a side opposite to the pump chamber is reduced.

The fluid control apparatus according to the present disclosure can be configured, for example, such that the drive control unit continuously decreases the driving power-supply voltage or the driving current. According to this configuration, driving efficiency is improved while reducing collision with the valve diaphragm.

The fluid control apparatus according to the present disclosure can be configured, for example, such that the drive control unit decreases the driving power-supply voltage or the driving current in a stepwise fashion. According to this configuration, the control is simplified while reducing collision with the valve diaphragm.

The fluid control apparatus according to the present disclosure can be configured, for example, such that the drive control unit performs control for decreasing the driving power-supply voltage one time during driving. According to this configuration, the control is further simplified.

The fluid control apparatus according to the present disclosure can be configured, for example, such that the drive control unit performs control so that the driving power-supply voltage or the driving current at a maximum value of the differential pressure becomes lower than the driving power-supply voltage or the driving current at a predetermined first differential pressure smaller than the maximum value of the differential pressure. According to this configuration, the control based on the differential pressure is performed with more certainty.

The fluid control apparatus according to the present disclosure can be configured such that the predetermined first differential pressure is an average of a minimum value of the differential pressure and the maximum value of the differential pressure. According to this configuration, the control based on the differential pressure is performed with more certainty, and driving efficiency is relatively improved.

The fluid control apparatus according to the present disclosure can be configured such that the drive control unit performs control for increasing the driving power-supply voltage or the driving current in accordance with an increase of the differential pressure and then performs control for decreasing the driving power-supply voltage or the driving current in accordance with an increase of the differential pressure.

According to this configuration, collision of the valve diaphragm with a wall of the valve chamber is reduced.

The fluid control apparatus according to the present disclosure may be configured as follows. The fluid control apparatus includes an opening closing valve that adjusts a pressure of the pressure vessel and a valve control unit that controls opening and closing of the opening closing valve. The drive control unit adjusts the driving power-supply voltage or a driving current corresponding to the driving power-supply voltage in accordance with an elapsed period from a time of start of control for closing the opening closing valve.

This configuration uses a one-to-one correspondence between the differential pressure and the elapsed period. A vibration state of the valve diaphragm varies depending on the elapsed period, and based on this, the driving power-supply voltage or the driving current is adjusted in accordance with the vibration state of the valve diaphragm. This adjusts a state of collision of the valve diaphragm with a wall that constitutes the valve chamber.

The fluid control apparatus according to the present disclosure can be configured such that the drive control unit increases the driving power-supply voltage or the driving current in accordance with the elapsed period from the time of the start of the control for closing the opening closing valve. According to this configuration, collision of the valve diaphragm with a wall of the valve chamber on a side opposite to the pump chamber is reduced.

The fluid control apparatus according to the present disclosure can be configured, for example, such that the drive control unit continuously increases the driving power-supply voltage or the driving current. According to this configuration, driving efficiency is improved while reducing collision with the valve diaphragm.

The fluid control apparatus according to the present disclosure can be configured, for example, such that the drive control unit increases the driving power-supply voltage or the driving current in a stepwise fashion. According to this configuration, the control is simplified while reducing collision with the valve diaphragm.

The fluid control apparatus according to the present disclosure can be configured, for example, such that the drive control unit performs control for increasing the driving power-supply voltage one time during driving. According to this configuration, the control is further simplified.

The fluid control apparatus according to the present disclosure can be configured, for example, such that the drive control unit performs control so that the driving power-supply voltage or the driving current at a midway time between the time of the start of the control for closing the opening closing valve and a time of start of control for opening the opening closing valve becomes higher than the driving power-supply voltage or the driving current at the time of the start of the control for closing the opening closing valve. According to this configuration, the control based on the differential pressure is performed with more certainty.

The fluid control apparatus according to the present disclosure can be configured, for example, such that the midway time is a time obtained by multiplying a time difference between the time of the start of the control for closing the opening closing valve and the time of the control for opening the opening closing valve by 0.5 assuming that the time difference is 1 and then adding the multiplied value to the time of the start of the control for closing the opening closing valve. According to this configuration, the control based on the differential pressure is performed with more certainty, and driving efficiency is relatively improved.

The fluid control apparatus according to the present disclosure can be configured, for example, such that the drive control unit decreases the driving power-supply voltage or the driving current in accordance with the elapsed period from the time of the start of the control for closing the opening closing valve. According to this configuration, collision of the valve diaphragm with a wall of the valve chamber on a pump chamber side is reduced.

The fluid control apparatus according to the present disclosure can be configured, for example, such that the drive control unit continuously decreases the driving power-supply voltage or the driving current. According to this configuration, driving efficiency is improved while reducing collision with the valve diaphragm.

The fluid control apparatus according to the present disclosure can be configured, for example, such that the drive control unit decreases the driving power-supply voltage or the driving current in a stepwise fashion. According to this configuration, the control is simplified while reducing collision with the valve diaphragm.

The fluid control apparatus according to the present disclosure can be configured, for example, such that the drive control unit performs control for decreasing the driving power-supply voltage one time during driving. According to this configuration, the control is further simplified.

The fluid control apparatus according to the present disclosure can be configured, for example, such that the drive control unit performs control so that the driving power-supply voltage or the driving current at a time of start of control for opening the opening closing valve becomes lower than the driving power-supply voltage or the driving current at a midway time that is earlier than the time of the start of the control for opening the opening closing valve.

According to this configuration, the control based on the differential pressure is performed with more certainty.

The fluid control apparatus according to the present disclosure can be configured such that the midway time is a time obtained by multiplying a time difference between the time of the start of the control for closing the opening closing valve and the time of the start of the control for opening the opening closing valve by 0.5 assuming that the time difference is 1 and then subtracting the multiplied value from the time of the start of the control for opening the opening closing valve. According to this configuration, the control based on the differential pressure is performed with more certainty, and driving efficiency is relatively improved.

The fluid control apparatus according to the present disclosure can be configured such that the drive control unit performs control for increasing the driving power-supply voltage or the driving current in accordance with the elapsed period from the time of the start of the control for closing the opening closing valve and then performs control for decreasing the driving power-supply voltage or the driving current in accordance with the elapsed period.

According to this configuration, collision of the valve diaphragm with a wall of the valve chamber is reduced.

The fluid control apparatus according to the present disclosure can be configured, for example, as follows. The fluid control apparatus according to the present disclosure includes a differential pressure detection unit that detects the differential pressure. The drive control unit adjusts the driving power-supply voltage or the driving current by using the differential pressure detected by the differential pressure detection unit.

According to this configuration, the differential pressure can be detected with certainty, and the control in the drive control unit is performed with more certainty.

The fluid control apparatus according to the present disclosure can be configured, for example, as follows. The drive control unit includes a time measuring unit. The time measuring unit measures the elapsed period in synchronization with control for opening and closing the opening closing valve.

According to this configuration, the control of the driving power-supply voltage is performed with higher precision in synchronization with opening and closing of the opening closing valve.

According to this disclosure, damage of the valve diaphragm of the piezoelectric pump can be reduced.

DETAILED DESCRIPTION

A fluid control apparatus according to an embodiment of the present disclosure is described below with reference to the drawings.

Figure 1A:
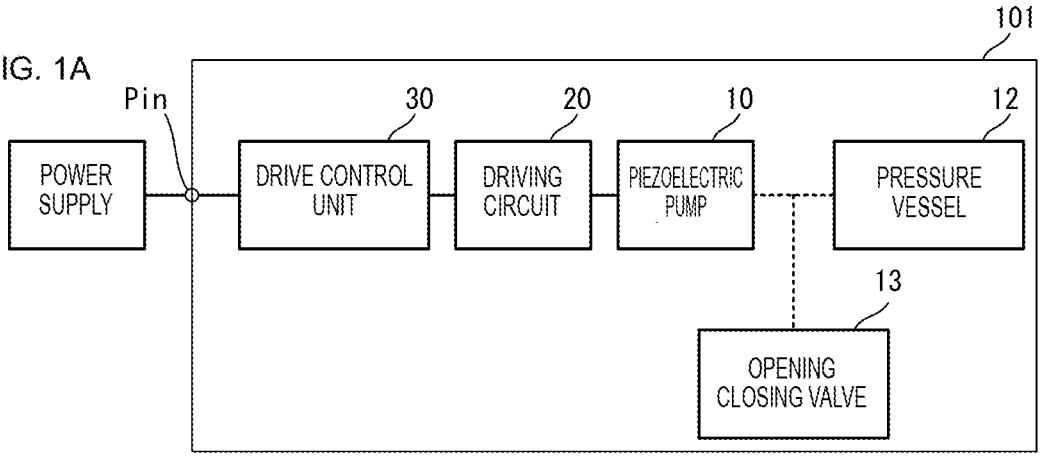
FIGS. 1A and 1B are block diagrams illustrating configurations of a fluid control apparatus 101 and a fluid control apparatus 101A according to a first embodiment, respectively.
Figure 1B:
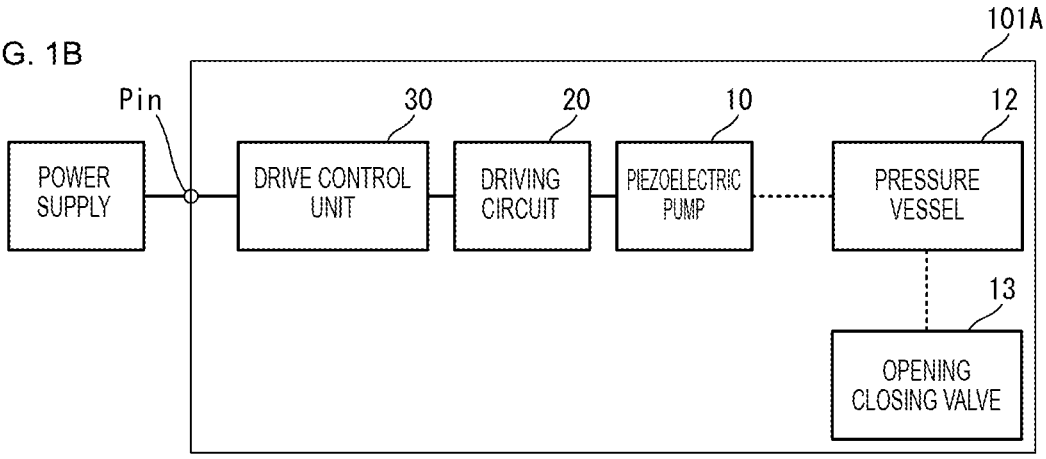

FIG. 1A is a block diagram illustrating a configuration of a fluid control apparatus 101, and FIG. 1B is a block diagram illustrating a configuration of a fluid control apparatus 101A.

As illustrated in FIG. 1A, the fluid control apparatus 101 includes a piezoelectric pump 10, a driving circuit 20, and a drive control unit 30 (e.g., a controller or the like). Furthermore, the fluid control apparatus 101 includes a pressure vessel 12 and an opening closing valve 13. At least one of the pressure vessel 12 and the opening closing valve 13 may be omitted from the fluid control apparatus 101.

The drive control unit 30 is connected to a power-supply voltage input unit Pin and the driving circuit 20. A power supply is connected to the power-supply voltage input unit Pin. The fluid control apparatus 101 may include the power supply.

The drive control unit 30 receives a driving power-supply voltage from the power supply, performs control in accordance with a vibration state of a valve diaphragm 130 (see FIG. 2) of the piezoelectric pump 10, and outputs the driving power-supply voltage to the driving circuit 20. Details of this will be described later.

The driving circuit 20 is, for example, a self-excited circuit. The driving circuit 20 generates a drive signal of a predetermined resonant frequency by using the driving power-supply voltage and applies the drive signal to a piezoelectric element 11 (see FIG. 2) of the piezoelectric pump 10.

The piezoelectric pump 10 includes the valve diaphragm 130 (see FIG. 2) and has a rectifying function. The piezoelectric pump 10 causes discharged fluid (e.g., air) to flow into the pressure vessel 12.

The opening closing valve 13 is, for example, an electromagnetic valve. The opening closing valve 13 is disposed on a flow passage between the piezoelectric pump 10 and the pressure vessel 12.

The pressure vessel 12 is, for example, one (e.g., a cuff) whose internal pressure can be changed. The internal pressure of the pressure vessel 12 increases when fluid flows into the pressure vessel 12 from the piezoelectric pump 10 while the opening closing valve 13 is being controlled to close. Meanwhile, the internal pressure of the pressure vessel 12 becomes equal to an external pressure when the opening closing valve 13 is controlled to open.

A configuration and overall operation of the fluid control apparatus 101A illustrated in FIG. 1B are similar to those of the fluid control apparatus 101 illustrated in FIG. 1A except for that the opening closing valve 13 is provided in the pressure vessel 12, and description of the fluid control apparatus 101A is omitted.

Figure 2:
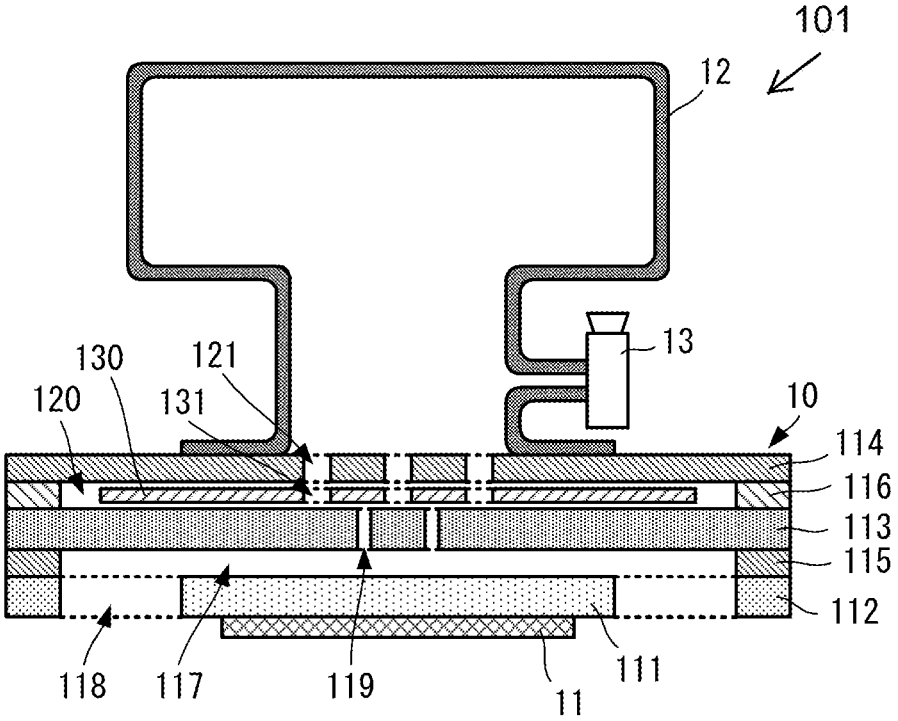
FIG. 2 is a side cross-sectional view illustrating a way in which a piezoelectric pump 10, a pressure vessel 12, and an opening closing valve 13 are connected.

FIG. 2 is a side cross-sectional view illustrating how the piezoelectric pump 10, the pressure vessel 12, and the opening closing valve 13 are connected.

As illustrated in FIG. 2, the piezoelectric pump 10 includes the piezoelectric element 11, a vibration plate 111, a support 112, a top plate 113, an outer plate 114, a frame 115, a frame 116, and the valve diaphragm 130.

An outer edge of the vibration plate 111 is supported by the support 112. The vibration plate 111 is supported so as to be able to vibrate in a direction orthogonal to a main surface of the vibration plate 111. There is a gap 118 between the vibration plate 111 and the support 112.

The piezoelectric element 11 is disposed on one main surface of the vibration plate 111. The piezoelectric element 11 includes, for example, a flat-plate-shaped piezoelectric body and a driving electrode provided on the piezoelectric body (not illustrated).

The top plate 113 is disposed so as to overlap the vibration plate 111 and the support 112 in plan view. The top plate 113 is disposed away from the vibration plate 111 and the support 112. The top plate 113 has a through-hole 119 in a substantially central region thereof in plan view.

The frame 115 has a cylindrical shape. The frame 115 is sandwiched between the support 112 and the top plate 113 and are joined to the support 112 and the top plate 113.

This creates a pump chamber 117, which is a space surrounded by the vibration plate 111, the support 112, the top plate 113, and the frame 115. The pump chamber 117 is communicated with the gap 118 and the through-hole 119. The gap 118 corresponds to a "pump chamber opening" of the present disclosure, and an outer space with which the pump chamber 117 is communicated through the gap 118 corresponds to a "pump chamber outer space" of the present disclosure.

The outer plate 114 is disposed on a side opposite to the vibration plate 111 relative to the top plate 113. The outer plate 114 is disposed so as to overlap the top plate 113 in plan view. The outer plate 114 is disposed away from the top plate 113.

The outer plate 114 has a through-hole 121 in a substantially central region thereof in plan view. The through-hole 121 does not overlap the through-hole 119 in plan view.

The frame 116 has a cylindrical shape. The frame 116 is sandwiched between the top plate 113 and the outer plate 114 and are joined to the top plate 113 and the outer plate 114.

This creates a valve chamber 120, which is a space surrounded by the top plate 113, the outer plate 114, and the frame 116. The valve chamber 120 is communicated with the through-hole 119 and the through-hole 121. The pressure vessel 12 is disposed so as to cover the through-hole 121 from an outer surface side of the outer plate 114. The through-hole 121 corresponds to a "valve chamber opening" of the present disclosure.

The valve diaphragm 130 is made of a flexible material. The valve diaphragm 130 has a through-hole 131. The valve diaphragm 130 is disposed in the valve chamber 120. The valve diaphragm 130 is disposed so that the through-hole 131 overlaps the through-hole 121 and does not overlap the through-hole 119 in plan view.

According to this configuration, when a drive signal from the driving circuit 20 is applied to the driving electrode of the piezoelectric element 11, the piezoelectric element 11 is displaced. The vibration plate 111 vibrates due to the displacement of the piezoelectric element 11. As a result, the pump chamber 117 alternates between a high-pressure state, in which the pressure of the pump chamber 117 is high relative to the external pressure, and a low-pressure state, in which the pressure of the pump chamber 117 is low relative to the external pressure.

In the low-pressure state, air is sucked into the pump chamber 117 from the outside through the gap 118. Meanwhile, in the high-pressure state, air is discharged into the valve chamber 120 through the through-hole 119.

When air flows from the through-hole 119, the valve diaphragm 130 vibrates toward the outer plate 114. As a result, the through-hole 131 of the valve diaphragm 130 and the through-hole 121 of the outer plate 114 overlap. This allows air in the valve chamber 120 to flow into the pressure vessel 12 through the through-hole 131 and the through-hole 121. When the opening closing valve 13 is controlled to close in this state, air in the valve chamber 120 flows into the pressure vessel 12 without necessarily leaking to the outside.

Meanwhile, when the pressure of the pressure vessel 12 becomes high due to the inflow of air, the air flows back from the pressure vessel 12 to the valve chamber 120 through the through-hole 121. However, when the air flows from the through-hole 121, the valve diaphragm 130 vibrates toward the top plate 113 and blocks the through-hole 119.

In this way, the piezoelectric pump 10 operates while using the gap 118 as an inlet and using the through-hole 121 as an outlet. That is, the piezoelectric pump 10 has a rectifying function. Accordingly, the piezoelectric pump 10 can prevent flowing back of air while allowing air to flow into the pressure vessel 12.

In a case where the operation of the piezoelectric pump 10 continues, the pressure in the pressure vessel 12 becomes high and a differential pressure becomes high until the opening closing valve 13 is controlled to open. The differential pressure is an absolute value of a difference between a pressure on the outlet side (a pressure in the valve chamber outer space) and a pressure on the inlet side (a pressure in the pump chamber outer space). In this case, the pressure on the outlet side is the same as or higher than the pressure on the inlet side, and therefore the differential pressure is a difference, calculated on the basis of the pressure on the inlet side, between the pressure on the outlet side and the pressure on the inlet side.

Meanwhile, when the opening closing valve 13 is controlled to open, air sucked into the pressure vessel 12 is released to the outside. This decreases the pressure in the pressure vessel 12. As a result, the differential pressure becomes 0.

The following problem occurs in such a configuration.

Figure 3A:
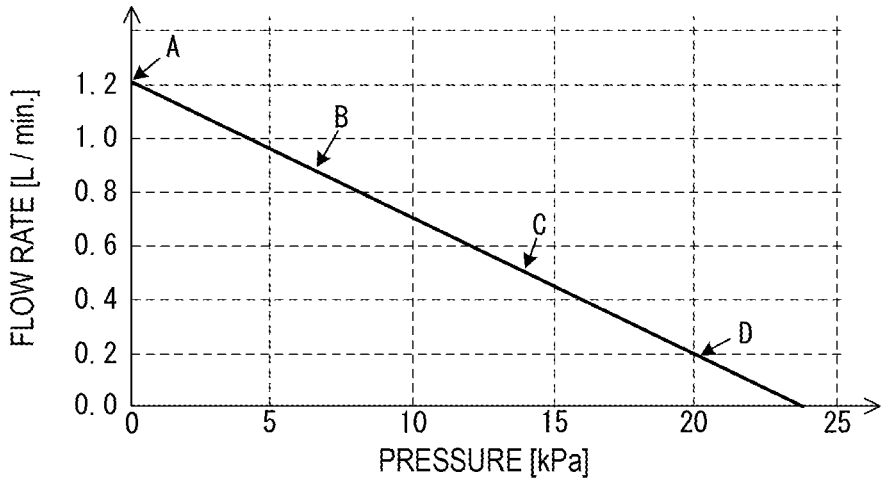
FIG. 3A is a graph illustrating a relationship between a pressure and a flow rate.
Figure 3B:
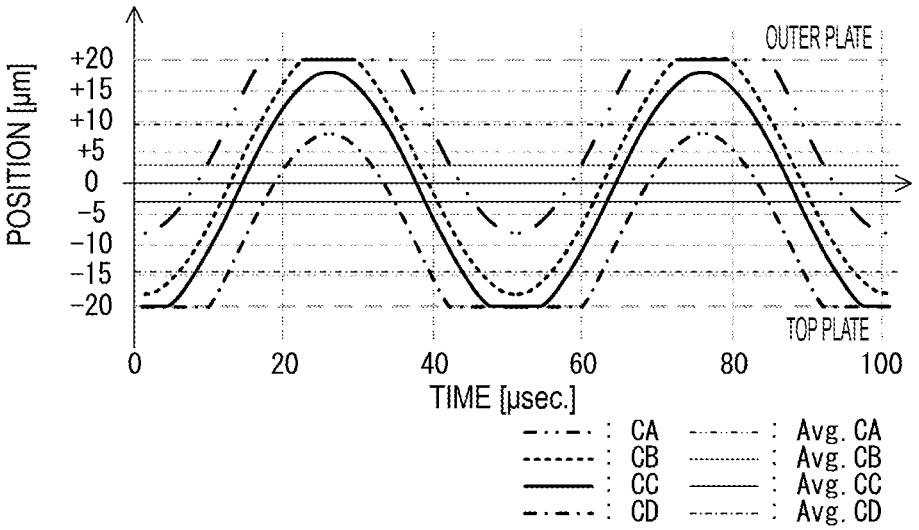
FIG. 3B illustrates states of a valve diaphragm 130 in a valve chamber 120 in cases where the relationship between a pressure and a flow rate illustrated in FIG. 3A is an A state, a B state, a C state, and a D state.

FIG. 3A is a graph illustrating a relationship between a pressure and a flow rate. The pressure is a difference (differential pressure) between an external pressure on the vibration plate 111 side of the piezoelectric pump 10 and the pressure in the pressure vessel 12 on the outer plate 114 side. FIG. 3B illustrates states of a valve diaphragm in a valve chamber in cases where the relationship between a pressure and a flow rate illustrated in FIG. 3A is an A state, a B state, a C state, and a D state. FIG. 3B illustrates a shape and an average position of the valve diaphragm at a certain timing. In FIG. 3B, the + side indicates a position closer to the outer plate 114, and the – side indicates a position closer to the top plate 113. A larger absolute value indicates a position closer to the outer plate 114 or the top plate 113. In FIG. 3B, the curves indicated by CA, CB, CC, and CD indicate shapes in the A state, the B state, the C state, and the D state, respectively, and straight lines indicated by Avg.CA, Avg.CB, Avg.CC, and Avg.CD indicate average positions in the A state, the B state, the C state, and the D state, respectively.

In an aspect in which the pressure vessel 12 is attached to the piezoelectric pump 10, the pressure becomes lower as the flow rate becomes higher (the flow rate becomes higher as the pressure becomes lower), and the flow rate becomes lower as the pressure becomes higher, as illustrated in FIG. 3A.

Specifically, the flow rate becomes high when an amount of air flowing into the pressure vessel 12 is small and the pressure is low. This occurs, for example, when the opening closing valve 13 shifts from an open state to a closed state and application of a driving power-supply voltage starts in the fluid control apparatus 101.

This state is referred to as a flow rate mode.

Meanwhile, the flow rate is low when an amount of air flowing into the pressure vessel 12 is large and the pressure is high. This occurs, for example, when the fluid control apparatus 101 is driven and a large amount of air is flowing into the pressure vessel 12 by the piezoelectric pump 10. This state is referred to as a pressure mode.

The A state illustrated in FIG. 3A indicates a state in the flow rate mode, and the D state indicates a state in the pressure mode. The B state and the C state are intermediate states between the A state and the D state (states in an intermediate mode). The B state is a state closer to the A state, and the C state is closer to the D state.

As illustrated in FIG. 3B, in the A state (flow rate mode), the valve diaphragm 130 is located closer to the outer plate 114 than to the top plate 113 and collides with the outer plate 114 at a high speed.

Meanwhile, in the D state (pressure mode), the valve diaphragm 130 is located closer to the top plate 113 than to the outer plate 114 and collides with the top plate 113 at a high speed.

In the B state and C state (intermediate mode), the valve diaphragm 130 is mainly located close to a center of the valve chamber 120 in a height direction and collides with the top plate 113 and the outer plate 114 at a lower speed than the A state and the D state.

Figure 4A:
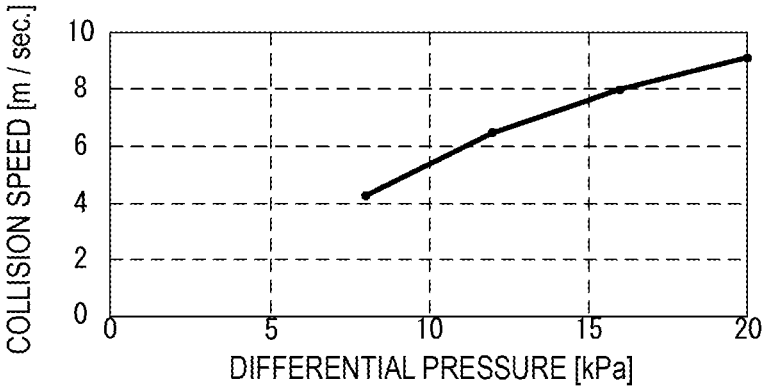
FIGS. 4A and 4B are graphs illustrating a relationship between a differential pressure and a collision speed.
Figure 4B:
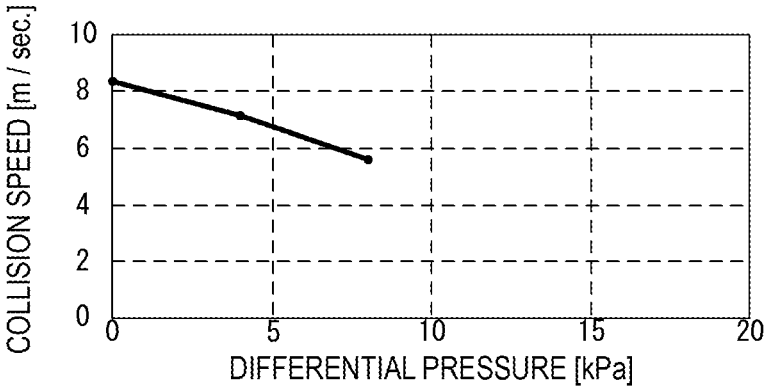
Figure 4C:
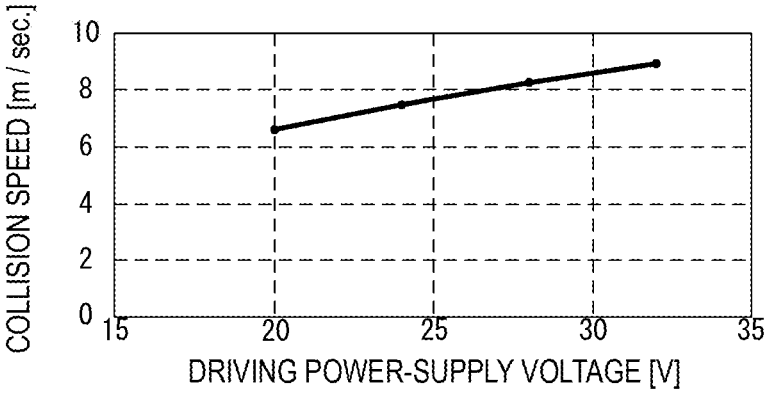
FIG. 4C is a graph illustrating a relationship between a driving power-supply voltage and a collision speed.

FIG. 4A and FIG. 4B are graphs illustrating a relationship between a differential pressure and a collision speed, and FIG. 4C is a graph illustrating a relationship between a driving power-supply voltage and a collision speed. FIG. 4A illustrates a collision speed at which the valve diaphragm collides with an outer plate in the A state (flow rate mode), and FIG. 4B illustrates a collision speed at which the valve diaphragm collides with the top plate in the D state (pressure mode). FIG. 4C illustrates a case where the differential pressure is 0.

As illustrated in FIG. 4A, in the A state (flow rate mode), the valve diaphragm and the outer plate collide with each other at a high speed, and the collision speed becomes higher as the differential pressure becomes higher. For this reason, in the A state (flow rate mode), the valve diaphragm 130 is easily broken due to the collision with the outer plate 114.

As illustrated in FIG. 4B, in the D state (pressure mode), the valve diaphragm and the top plate collide with each other at a high speed, and the collision speed becomes higher as the differential pressure becomes lower. For this reason, in the D state (pressure mode), the valve diaphragm 130 is easily broken due to the collision with the top plate 113.

As illustrated in FIG. 4C, the collision speed becomes higher as the driving power-supply voltage becomes higher.

Therefore, the drive control unit 30 of the fluid control apparatus 101 (101A) controls the driving power-supply voltage as follows.

(Control in Flow Rate Mode)

Figure 5A:
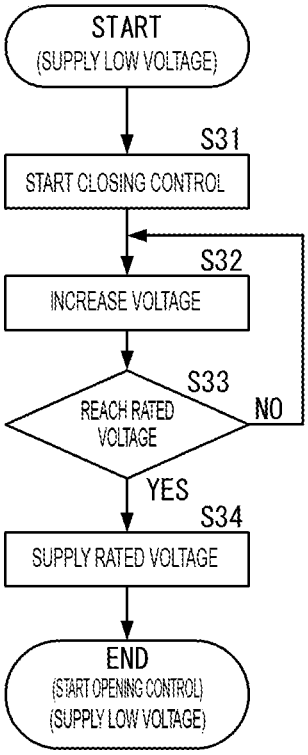
FIGS. 5A and 5B are flowcharts illustrating control of the driving power-supply voltage.
Figure 5B:
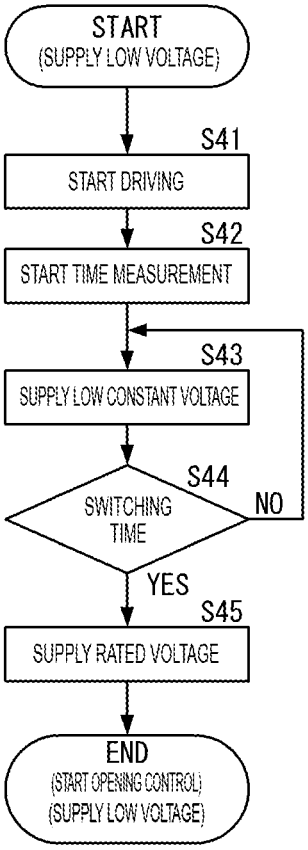
Figure 6A:
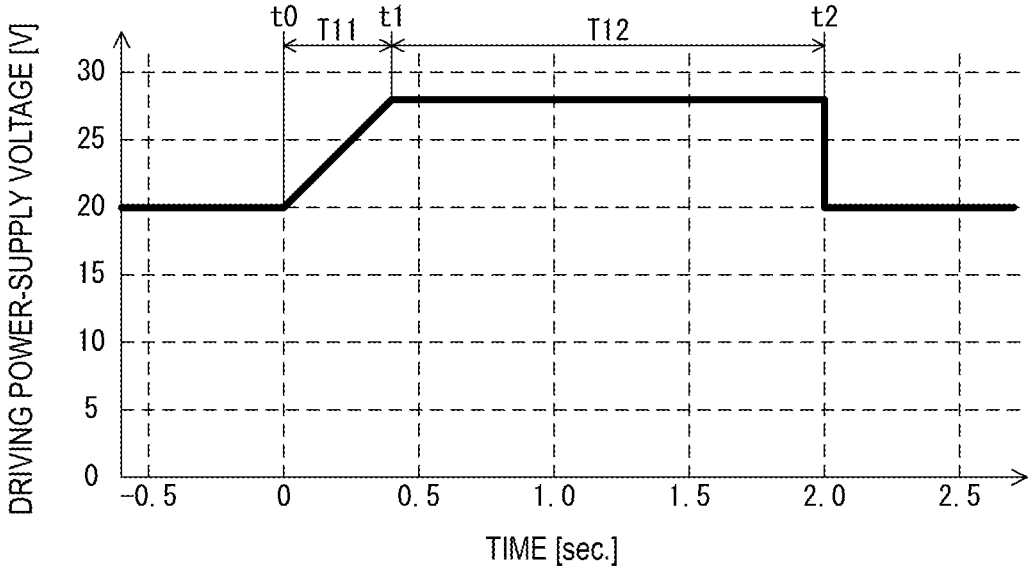
FIGS. 6A and 6B are graphs illustrating a change of the driving power-supply voltage over passage of time.
Figure 6B:
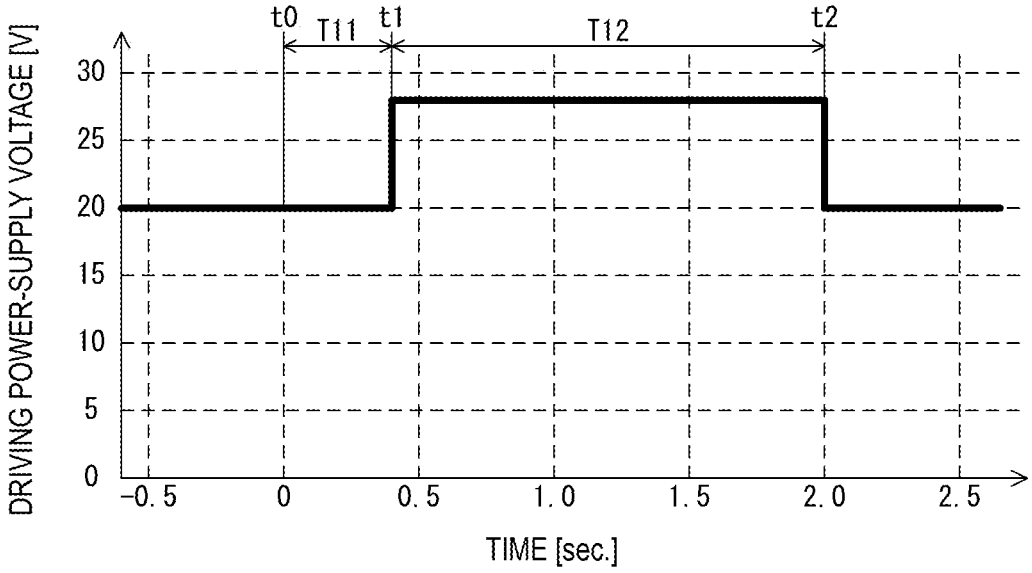

FIGS. 5A and 5B are flow charts illustrating control of the driving power-supply voltage. FIGS. 6A and 6B are graphs illustrating a change of the driving power-supply voltage over passage of time. FIG. 6A corresponds to the flow of FIG. 5A, and FIG. 6B corresponds to the flow of FIG. 5B.

(Continuous Increasing Control)

In the control illustrated in FIG. 5A, first, the fluid control apparatus starts control for closing the opening closing valve 13 during supply of a driving power-supply voltage (during supply of a low voltage) (S31). For example, the driving power-supply voltage at the time of the start of the closing control is set to a voltage value (20 V in the example of FIG. 6A) lower than a driving power-supply voltage during steady-state operation (28 V in the example of FIG. 6A) as illustrated in FIG. 6A.

The drive control unit 30 gradually increases the driving power-supply voltage with passage of time (S32). That is, the drive control unit 30 increases the driving power-supply voltage at a predetermined increase rate. For example, the drive control unit 30 increases the driving power-supply voltage by a predetermined voltage per second.

In the example of FIG. 6A, the drive control unit 30 increases the driving power-supply voltage at a rate of 20 V/sec. The increase of the voltage may be continuous as illustrated in FIG. 6A or may be discrete (stepwise).

The drive control unit 30 increases the voltage (S32) until the driving power-supply voltage reaches a rated voltage (the driving power-supply voltage during steady-state operation) (NO in S33). When the driving power-supply voltage reaches the rated voltage (the driving power-supply voltage during steady-state operation) (YES in S33), the drive control unit 30 supplies the rated voltage (S34).

In the example of FIG. 6A, the drive control unit 30 gradually increases the voltage during a first period T11 from a time t0, at which the closing control starts, to a time t1, at which the driving power-supply voltage reaches the rated voltage. The drive control unit 30 supplies the rated voltage during a second period T12 from the time t1 to a time t2, at which the opening closing valve 13 is controlled to open. At the time t2, the fluid control apparatus switches the closing control to control for opening the opening closing valve 13 and decreases the driving power-supply voltage.

(Stepwise Increasing Control)

In the control illustrated in FIG. 5B, first, the fluid control apparatus starts control for closing the opening closing valve 13 during supply of the driving power-supply voltage (during supply of a low voltage) (S41). For example, the driving power-supply voltage at a time of start of the closing control is set to a constant voltage value (low voltage: 20 V in the example of FIG. 6B) lower than a driving power-supply voltage during steady-state operation (28 V in the example of FIG. 6B) as illustrated in FIG. 6B. At this timing, the drive control unit 30 starts time measurement (S42).

The drive control unit 30 continues to supply this low voltage (S43) until a voltage switching time is detected (NO in S44).

The drive control unit 30 supplies a rated voltage (S45) when the voltage switching time is detected (YES in S44).

In the example of FIG. 6B, the drive control unit 30 supplies an initial constant voltage lower than the rated voltage during a first period T11 from a time t0, at which driving starts, to a time t1, which is the switching time. The drive control unit 30 supplies the rated voltage during a second period T12 from the time t1 to a time t2, at which the opening closing valve 13 is controlled to open. At the time t2, the fluid control apparatus switches the closing control to control for opening the opening closing valve 13 and decreases the driving power-supply voltage.

By performing the above control, it is possible to keep the driving power-supply voltage supplied to the piezoelectric pump 10 low in the flow rate mode. This can reduce breakage of the valve diaphragm 130 that occurs due to collision with the outer plate 114. The control illustrated in FIG. 5A can make operation of the piezoelectric pump 10 closer to the steady-state operation more quickly. Meanwhile, the control illustrated in FIG. 5B makes control of the power-supply voltage easy. This can, for example, simplify a circuit configuration.

(Other Increasing Control)

Figure 7A:
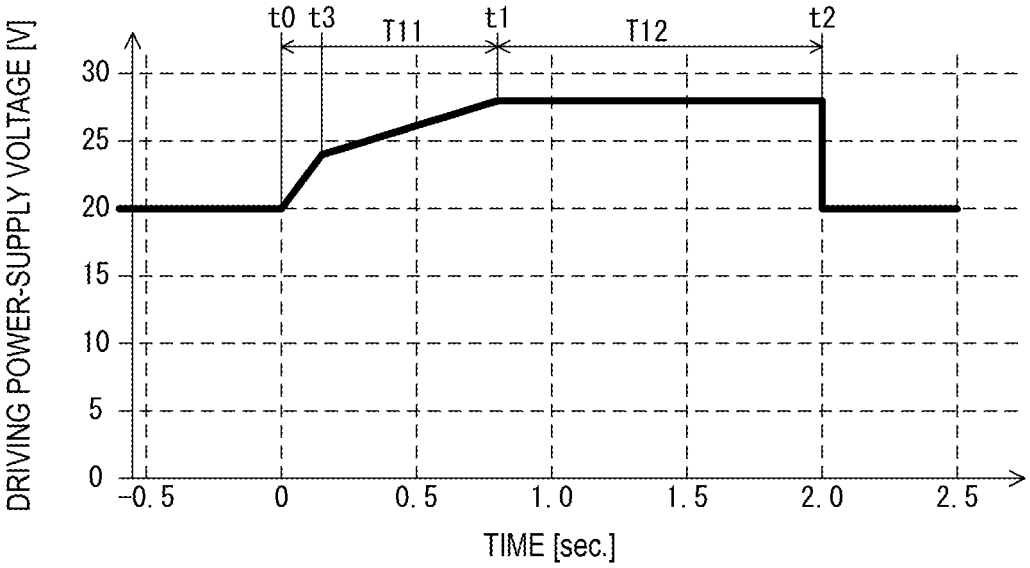
FIGS. 7A and 7B are graphs illustrating a change of the driving power-supply voltage over passage of time.
Figure 7B:
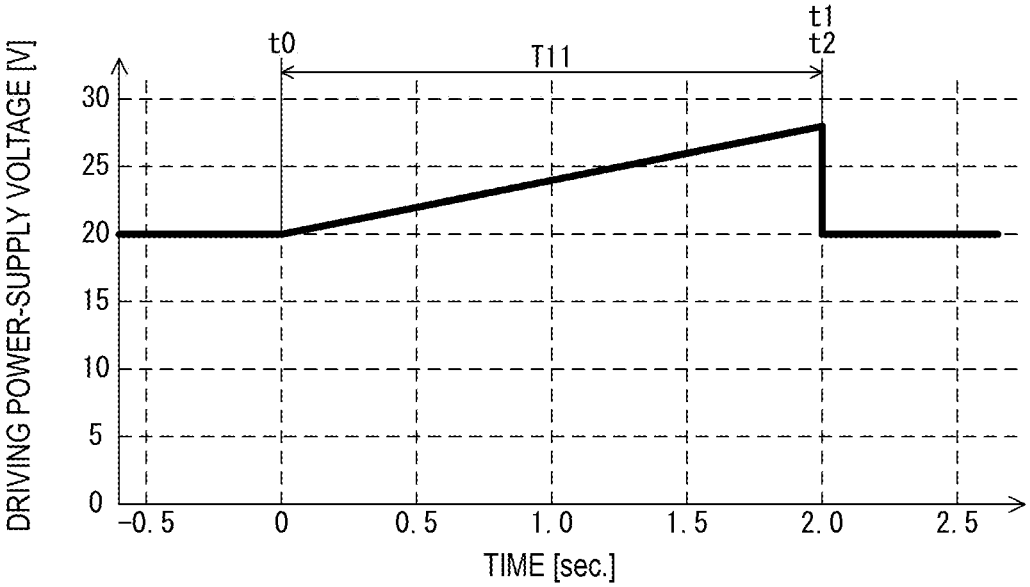

The drive control unit 30 may perform control illustrated in FIGS. 7A and 7B. FIGS. 7A and 7B are graphs illustrating a change of the driving power-supply voltage over passage of time.

In the control illustrated in FIG. 7A, the voltage increases at plural rates during a first period. Although FIG. 7A illustrates an aspect in which an initial increase rate is higher than a later increase rate, the later increase rate may be higher than the initial increase rate. In a case where the initial increase rate is higher than the later increase rate, the piezoelectric pump can be activated more quickly. Meanwhile, in a case where the initial increase rate is lower than the later increase rate, breakage of the valve diaphragm can be reduced more effectively.

In the control illustrated in FIG. 7B, the driving power-supply voltage continues to be increased from a time of start of control for closing the opening closing valve 13 to a time of start of control for opening the opening closing valve 13 so that the driving power-supply voltage reaches a rated voltage at the time of the opening control.

In the above control in the flow rate mode, the drive control unit 30 need just increase the driving power-supply voltage at least at or after start of the control for closing the opening closing valve 13. However, for example, a time obtained by multiplying a time difference between the time of the start of the control for closing the opening closing valve 13 and the time of the start of the control for opening the opening closing valve 13 by a predetermined value (a value smaller than 1) and then adding the multiplied value to the time of the start of the closing control is set as a midway time. The drive control unit 30 preferably performs control so that the driving power-supply voltage at this midway time becomes higher than the driving power-supply voltage at the time of the start of the closing control. This predetermined value can be, for example, approximately 0.5. For example, in a case where the predetermined value is approximately 0.5, drive efficiency of the piezoelectric pump 10 can be improved while reducing breakage of the valve diaphragm.

The above description has discussed an aspect in which voltage control is performed by using a period elapsed from a time of start of control for closing the opening closing valve. This uses a one-to-one correspondence between the differential pressure and the elapsed period and a one-to-one correspondence between the differential pressure and a vibration state. Accordingly, the voltage control can be performed by using the elapsed period if the differential pressure cannot be measured and by using the differential pressure if the differential pressure can be measured.

In this case, for example, a pressure obtained by multiplying a difference between a minimum value of the differential pressure (e.g., a differential pressure at the time of the start of the driving power-supply voltage) and a maximum value of the differential pressure by a predetermined value (a value smaller than 1) and then adding the multiplied value to the minimum value is set as a midway differential pressure. The drive control unit 30 preferably performs control so that the driving power-supply voltage at this midway differential pressure becomes higher than the driving power-supply voltage at the minimum value of the differential pressure. The predetermined value can be, for example, approximately 0.5. In a case where the predetermined value is approximately 0.5, the midway differential pressure is an average of the minimum value and the maximum value of the differential pressure. For example, in a case where the predetermined value is approximately 0.5, drive efficiency of the piezoelectric pump 10 can be improved while reducing breakage of the valve diaphragm.

Figure 8A:
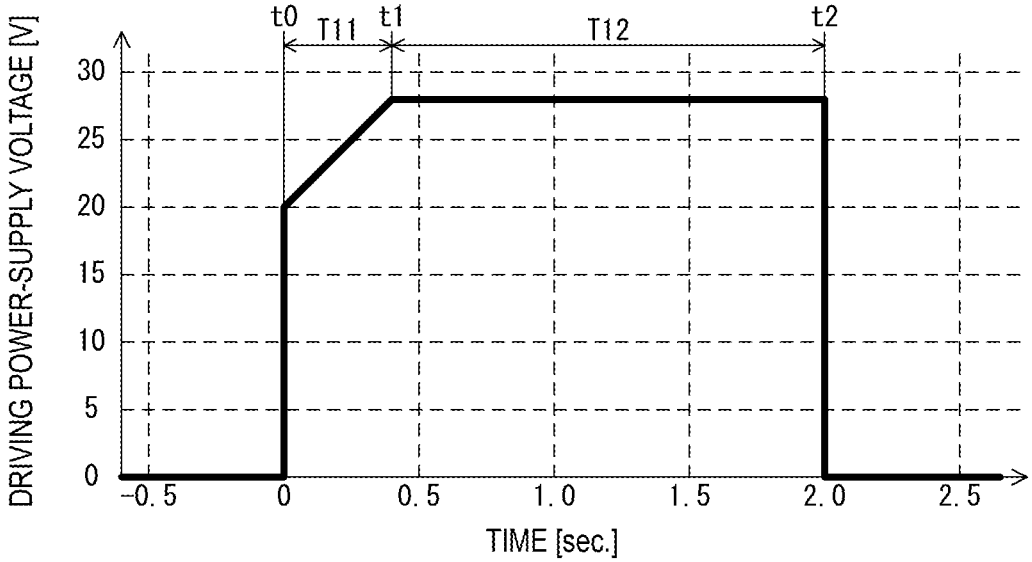
FIGS. 8A and 8B are graphs illustrating a change of the driving power-supply voltage over passage of time.
Figure 8B:
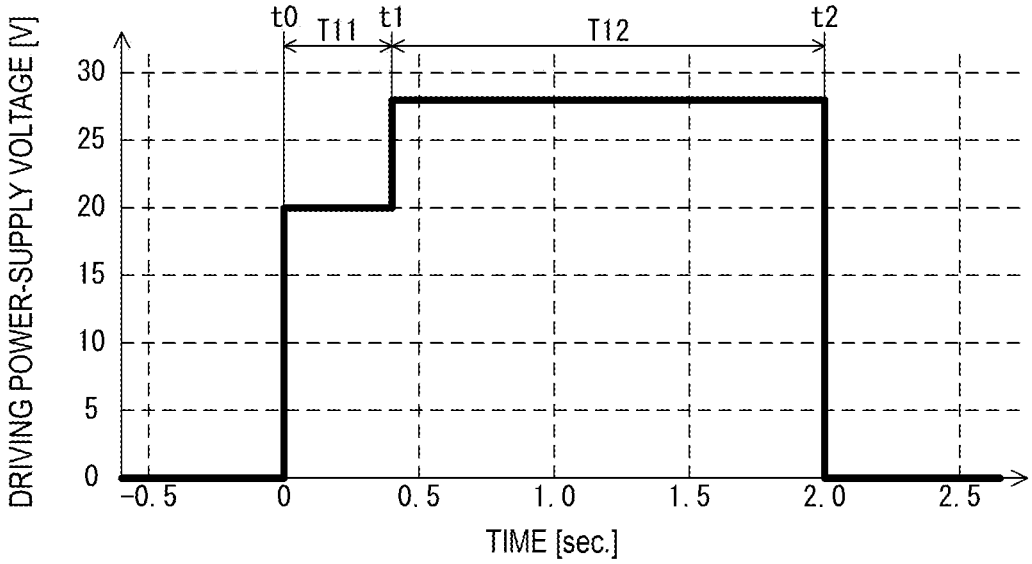

The above description has discussed an aspect in which the control for closing the opening closing valve 13 starts during supply of the driving power-supply voltage. However, supply of the driving power-supply voltage and the start of the control for closing the opening closing valve 13 may be concurrent. Furthermore, supply of the driving power-supply voltage may be stopped at the same time as the start of the control for opening the opening closing valve 13. In this case, the driving power-supply voltage changes over passage of time as illustrated in FIGS. 8A and 8B. FIGS. 8A and 8B are graphs illustrating a change of the driving power-supply voltage over passage of time.

(Control in Pressure Mode)

Figure 9A:
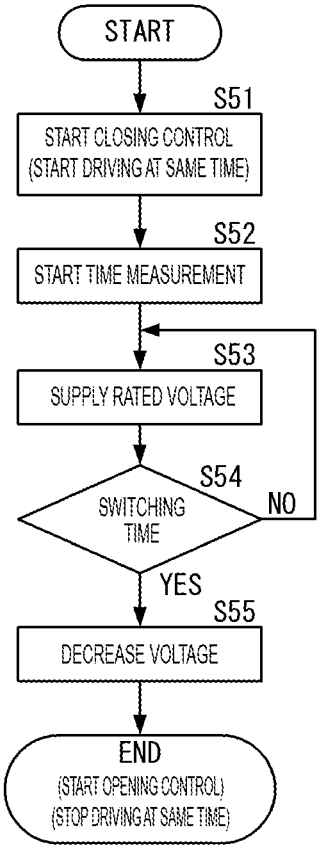
FIGS. 9A and 9B are flowcharts illustrating control of the driving power-supply voltage.
Figure 9B:
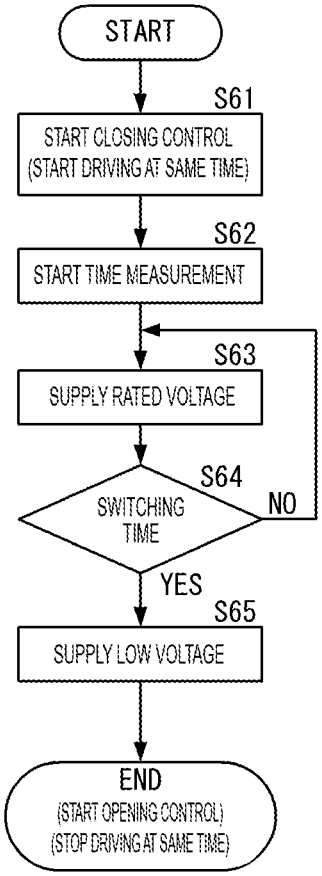
Figure 10A:
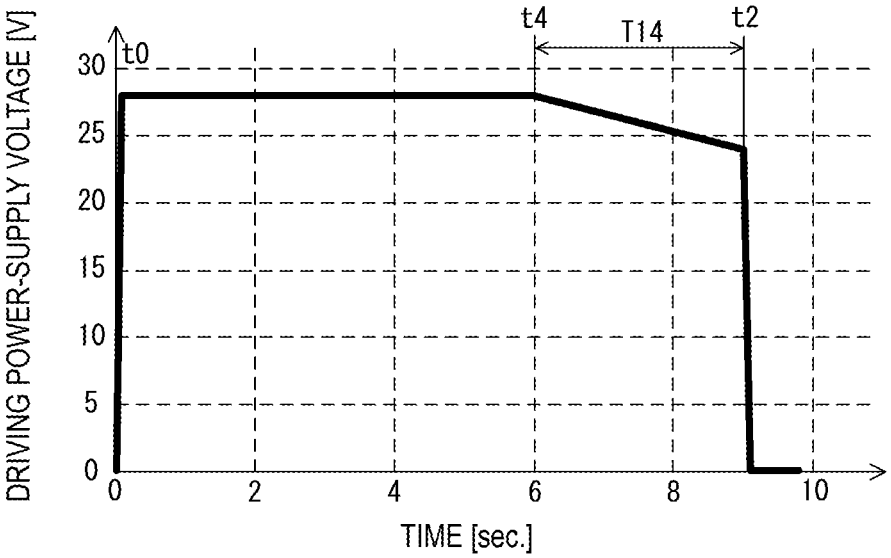
FIGS. 10A and 10B are graphs illustrating a change of the driving power-supply voltage over passage of time.
Figure 10B:
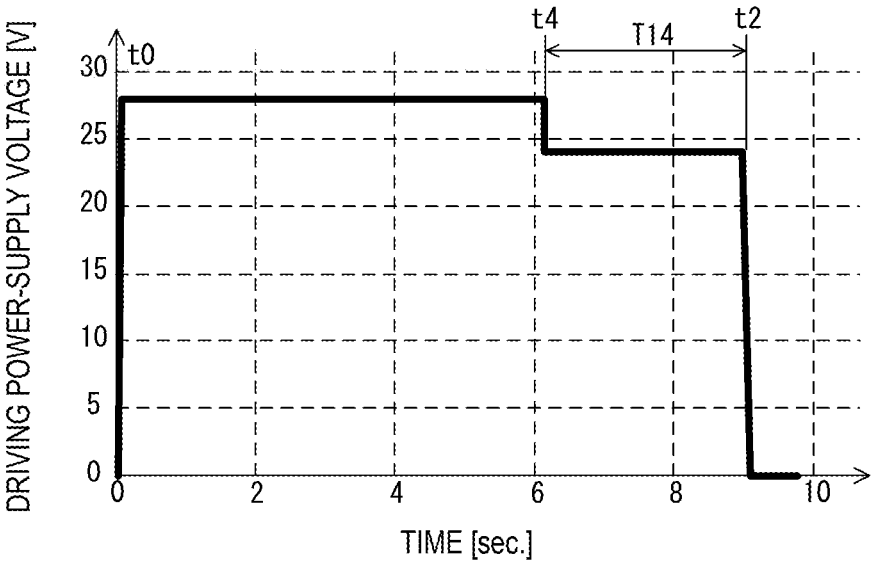

FIGS. 9A and 9B are flowcharts illustrating control of the driving power-supply voltage. FIGS. 10A and 10B are graphs illustrating a change of the driving power-supply voltage over passage of time. FIG. 10A corresponds to the flow of FIG. 9A, and FIG. 10B corresponds to the flow of FIG. 9B.

(Continuous Decreasing Control)

In the control illustrated in FIG. 9A, first, the fluid control apparatus starts control for closing the opening closing valve 13 at the same time as start of supply of the driving power-supply voltage (S51). The driving power-supply voltage is set, for example, to the driving power-supply voltage during steady-state operation (rated voltage: 28 V in the example of FIG. 10A). At this timing, the fluid control apparatus starts time measurement (S52).

The drive control unit 30 continues to supply the rated voltage (S53) until a voltage switching time is detected (NO in S54).

The drive control unit 30 gradually decreases the driving power-supply voltage over passage of time (S55) when the voltage switching time is detected (YES in S54). That is, the drive control unit 30 decreases the driving power-supply voltage at a predetermined decrease rate. For example, the drive control unit 30 decreases the driving power-supply voltage by a predetermined voltage per second. For example, in the example of FIG. 10A, the drive control unit 30 decreases the driving power-supply voltage at a rate of 1.3V/sec. The decrease of the voltage may be continuous as illustrated in FIG. 10A or may be discrete (stepwise).

In the example of FIG. 10A, the drive control unit 30 supplies the rated voltage during a period from a time t0, at which driving starts, to a time t4, which is a switching time. The drive control unit 30 gradually decreases the driving power-supply voltage with passage of time during a third period T14 from the time t4 to a time t2, at which the opening closing valve 13 is controlled to open. At the time t2, the fluid control apparatus switches the closing control to control for opening the opening closing valve 13 and stops supply of the driving power-supply voltage.

In the control illustrated in FIG. 9B, first, the fluid control apparatus starts control for closing the opening closing valve 13 at the same time as start of supply of the driving power-supply voltage (S61). The driving power-supply voltage is set, for example, to the driving power-supply voltage during steady-state operation (rated voltage: 28 V in the example of FIG. 10B). At this timing, the fluid control apparatus starts time measurement (S62).

The drive control unit 30 continues to supply the rated voltage (S63) until a voltage switching time is detected (NO in S64).

When the voltage switching time is detected (YES in S64), the drive control unit 30 supplies a constant voltage value (low voltage: 24 V in the example of FIG. 10B) lower than the driving power-supply voltage during steady-state operation (28 V in the example of FIG. 10B) (S65) as illustrated in FIG. 10B.

In the example of FIG. 10B, the drive control unit 30 supplies the rated voltage during a period from a time t0, at which driving starts, to a time t4, which is a switching time. The drive control unit 30 supplies the constant voltage lower than the rated voltage during a third period T14 from the time t4 to a time t2, at which the opening closing valve 13 is controlled to open. At the time t2, the fluid control apparatus switches the closing control to control for opening the opening closing valve 13 and stops supply of the driving power-supply voltage.

By performing the above control, the driving power-supply voltage supplied to the piezoelectric pump 10 can be kept low in the pressure mode. This can reduce breakage of the valve diaphragm 130 that occurs due to collision with the top plate 113. The control illustrated in FIG. 10A can keep a state where the operation of the piezoelectric pump 10 is close to steady-state operation for a longer period. Meanwhile, the control illustrated in FIG. 10B makes it easy to control the driving power-supply voltage. This can, for example, simplify a circuit configuration.

(Other Decreasing Control)

Figure 11A:
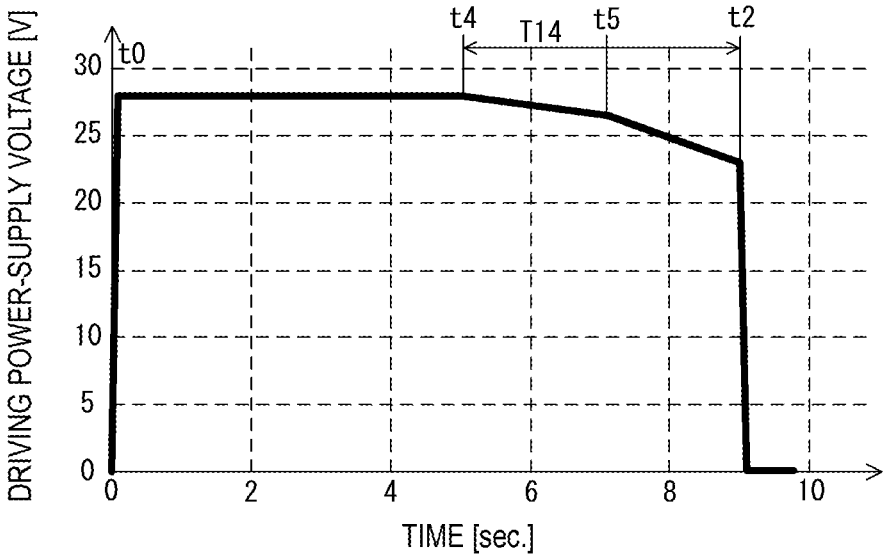
FIGS. 11A and 11B are graphs illustrating a change of the driving power-supply voltage over passage of time.
Figure 11B:
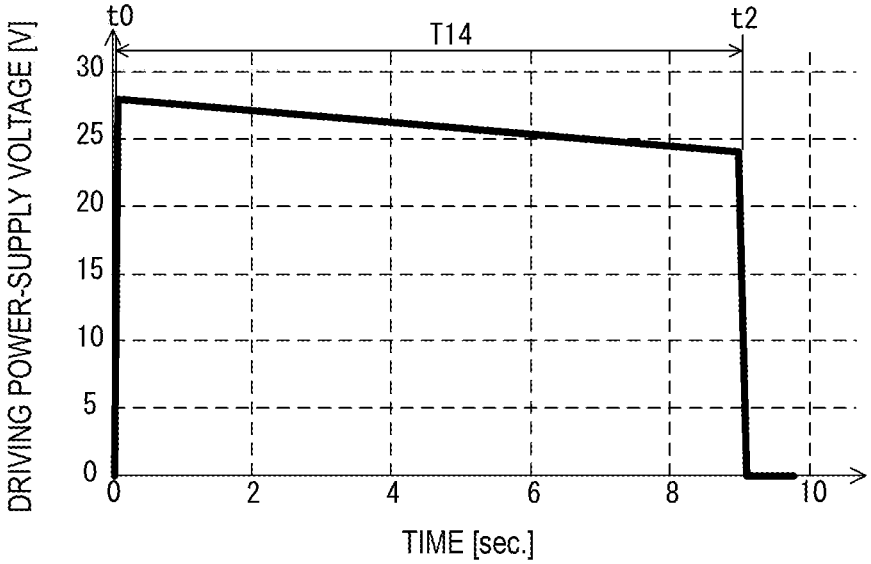

The drive control unit 30 may perform control illustrated in FIGS. 11A and 11B. FIGS. 11A and 11B are graphs illustrating a change of the driving power-supply voltage over passage of time.

In the control illustrated in FIG. 11A, the voltage decreases at plural rates during a third period. Although FIG. 10A illustrates an aspect in which an earlier decrease rate is lower than a later decrease rate during the decrease of the pressure, the later decrease rate may be lower than the earlier decrease rate. In a case where the earlier decrease rate is lower than the later decrease rate, a state where performance of the piezoelectric pump is close to one during rated operation can be kept long. Meanwhile, in a case where the earlier decrease rate is higher than the later decrease rate, breakage of the valve diaphragm can be reduced more effectively.

In the control illustrated in FIG. 11B, the driving power-supply voltage continues to be decreased from a time of start of control for closing the opening closing valve to a time of start of control for opening the opening closing valve.

In this case, the drive control unit 30 need just decrease the driving power-supply voltage at least by the time of the start of the control for opening the opening closing valve 13. However, for example, a time obtained by multiplying a time difference between the time of the start of the control for closing the opening closing valve 13 and the time of the start of the control for opening the opening closing valve 13 by a predetermined value (a value smaller than 1) and then going back from the time of the start of the opening control by the multiplied value (subtracting the multiplied value from the time of the start of the opening control) is set as a midway time. The drive control unit 30 preferably performs control so that the driving power-supply voltage at the time of the start of the control for opening the opening closing valve 13 becomes lower than the driving power-supply voltage at the midway time. This predetermined value can be, for example, approximately 0.5. For example, in a case where the predetermined value is approximately 0.5, drive efficiency of the piezoelectric pump 10 can be improved while reducing breakage of the valve diaphragm.

The above description has discussed an aspect in which voltage control is performed by using a period to a time of start of control for opening the opening closing valve. This uses a one-to-one correspondence between the differential pressure and the elapsed period and a one-to-one correspondence between the differential pressure and a vibration state. Accordingly, voltage control may be performed by using the period to the time of the start of the opening control if the differential pressure cannot be measured and using the differential pressure if the differential pressure can be measured.

In this case, for example, a pressure obtained by multiplying a difference between a minimum value of the differential pressure (e.g., a differential pressure at the time of the start of the control for closing the opening closing valve 13) and a maximum value of the differential pressure by a predetermined value (a value smaller than 1) and then adding the multiplied value to the minimum value is set as a midway differential pressure (corresponding to a "first differential pressure" of the present disclosure). The drive control unit 30 preferably performs control so that the driving power-supply voltage at the maximum differential pressure becomes lower than the driving power-supply voltage at the midway differential pressure. This predetermined value can be, for example, approximately 0.5. In a case where the predetermined value is approximately 0.5, the midway differential pressure is an average of the minimum value and the maximum value of the differential pressure. For example, in a case where the predetermined value is approximately 0.5, drive efficiency of the piezoelectric pump 10 can be improved while reducing breakage of the valve diaphragm.

The above description has discussed an aspect in which control in the flow rate mode and control in the pressure mode are individually executed. These kinds of control may be executed in combination. This reduces breakage of the valve diaphragm more effectively with more certainty.

Specific Example 1 of Circuit Configuration

The control for continuously increasing the driving power-supply voltage as illustrated in FIG. 8A can be realized, for example, by a circuit configuration described below.

Figure 12A:
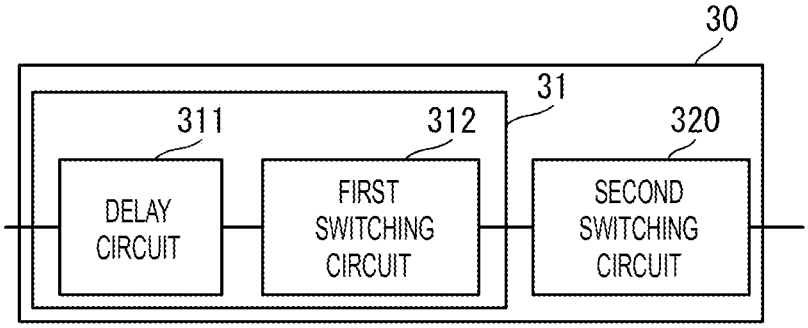
FIG. 12A is a functional block illustrating an aspect of a drive control unit 30.
Figure 12B:
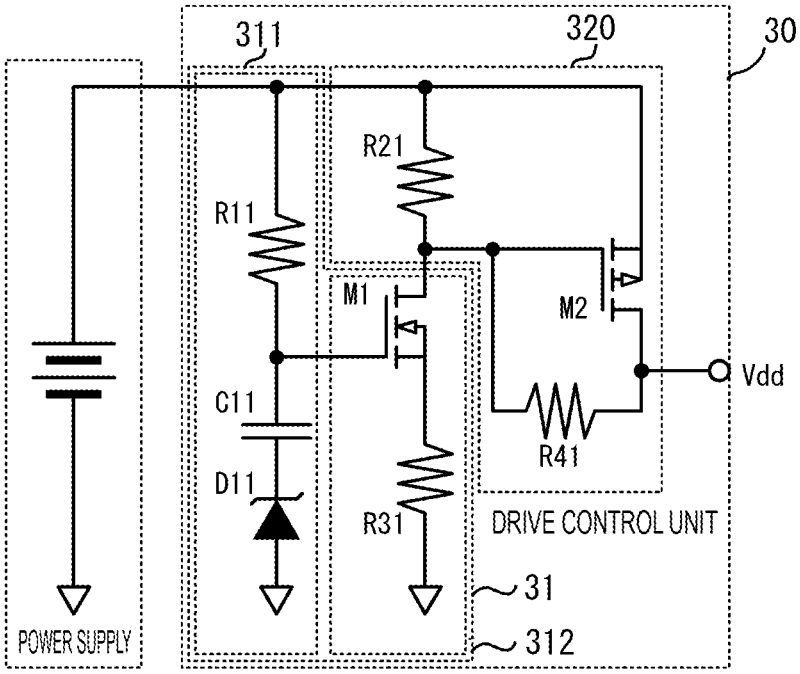
FIG. 12B is a circuit diagram of the drive control unit 30.

FIG. 12A is a functional block illustrating an aspect of the drive control unit 30, and FIG. 12B is a circuit diagram of the drive control unit 30.

As illustrated in FIG. 12A, the drive control unit 30 includes a delay circuit 311, a first switching circuit 312, and a second switching circuit 320. The delay circuit 311 and the first switching circuit 312 constitute a first circuit 31. The delay circuit 311, the first switching circuit 312, and the second switching circuit 320 are connected in this order from the power supply side, and an output end of the second switching circuit 320 is connected to the driving circuit 20.

The delay circuit 311 delays a time of start of operation of the first switching circuit 312 relative to a time of start of driving.

The first switching circuit 312 generates a voltage for adjusting an output voltage of the second switching circuit 320.

The second switching circuit 320 outputs an initial voltage Vddp lower than the power-supply voltage in an initial state (at the time of the start of driving). The second switching circuit 320 gradually increases the output voltage from the initial voltage Vddp during a period in which the output voltage is controlled by the first switching circuit 312. When control for maximizing output is performed by the first switching circuit 312, the second switching circuit 320 outputs a driving power-supply voltage Vddo of steady-state operation to the driving circuit 20.

According to this configuration, the drive control unit 30 can continuously increase the voltage during a predetermined period from the start of driving and then continuously output a constant rated voltage as in FIG. 8A.

In a case where the drive control unit 30 configured as above is realized by an analog circuit, the drive control unit 30 can be realized, for example, by the configuration illustrated in FIG. 12B. As illustrated in FIG. 12B, the drive control unit 30 is connected to the power supply. The drive control unit 30 includes a resistive element R11, a resistive element R21, a resistive element R31, a resistive element R41, a capacitor C11, a diode D11, an FET M1, and an FET M2. The FET M1 is an n-type FET, and the FET M2 is a p-type FET.

A first terminal of the resistive element R11 is connected to a positive side of the power supply. A negative side of the power supply is connected to a reference potential (grounded in an alternating-current manner). A second terminal of the resistive element R11 is connected to a first terminal of the capacitor C11, and a second terminal of the capacitor C11 is connected to a cathode of the diode D11. An anode of the diode D11 is connected to the reference potential.

A gate terminal of the FET M1 is connected to a connection line between the resistive element R11 and the capacitor C11.

A first terminal of the resistive element R21 is connected to the positive side of the power supply. A second terminal of the resistive element R21 is connected to a drain terminal of the FET M1. A source terminal of the FET M1 is connected to a first terminal of the resistive element R31, and a second terminal of the resistive element R31 is connected to the reference potential.

A gate terminal of the FET M2 is connected to the resistive element R21, the drain terminal the FET M1, and a second terminal of the resistive element R41.

A source terminal of the FET M2 is connected to the positive side of the power supply. A drain terminal of the FET M2 is connected to a first terminal of the resistive element R41, and the second terminal of the resistive element R41 is connected to the second terminal of the resistive element R21.

An output terminal of the drive control unit 30 from which the power-supply voltage Vdd is output is connected to the drain terminal of the FET M2 and has the same potential as the drain terminal of the FET M2.

When the power-supply voltage is applied from the power supply in such a circuit configuration, the driving power-supply voltage Vdd changes while sequentially undergoing the following states.

(First Pressure Rising Period)

When application of the power-supply voltage to the drive control unit 30 starts, charging of the capacitor C11 starts. The initial voltage Vddp of the driving power-supply voltage Vdd is decided by voltage division among the resistive elements R21 and R41 and the subsequent driving circuit 20.

Accordingly, the initial voltage Vddp is set to a value lower than the driving power-supply voltage (finally desired driving power-supply voltage) Vddo of steady-state operation, and a voltage division ratio of the resistive elements R21 and R41 and the driving circuit 20 is set so that the initial voltage Vddp is obtained. For example, in a case where the driving power-supply voltage (rated voltage) Vddo of steady-state operation is approximately 28 V, the initial voltage Vddp is set to approximately 20 V. That is, the initial voltage Vddp is set by using the voltage division ratio of the resistive elements R21 and R41 and the driving circuit 20 in a state where the FET M2 is off.

This causes the driving power-supply voltage Vdd to rise to the initial voltage Vddp lower than the driving power-supply voltage Vddo of steady-state operation in a very short period T1.

In a case where charging of the capacitor C11 continues during this period T1, a gate voltage of the FET M1 rises in accordance with a time constant based on element values of the resistive element R11, the capacitor C11, and the diode D11.

(Second Pressure Rising Period)

When the gate voltage of the FET M1 rises and exceeds a threshold value relative to a source voltage of the FET M1, the FET M1 starts conduction.

A gate voltage of the FET M2 gradually decreases accordingly. That is, the gate voltage of the FET M2 is gradually decreased by using an unsaturated zone of the FET M1.

When the gate voltage of the FET M2 decreases, a gate-source voltage of the FET M2 becomes negative. Accordingly, when the gate voltage of the FET M2 gradually decreases, a voltage drop occurring between the drain and the source of the FET M2 gradually decreases. That is, the voltage between the drain and the source of the FET M2 is gradually increased by using an unsaturated zone of the FET M2.

Accordingly, the driving power-supply voltage Vdd is decided by a voltage drop amount of a series-parallel combined resistance of the FET M2 and the resistive elements R21 and R41 and a voltage division ratio with the driving circuit 20. Accordingly, the driving power-supply voltage Vdd gradually rises continuously from the initial voltage Vddp and converges after reaching the driving power-supply voltage Vddo of steady-state operation.

Although an aspect in which an FET is used has been described above, other semiconductor elements can also be used.

Specific Example 2 of Circuit Configuration

The control for continuously increasing the driving power-supply voltage as illustrated in FIG. 8A can also be realized, for example, by a circuit configuration described below.

Figure 13A:
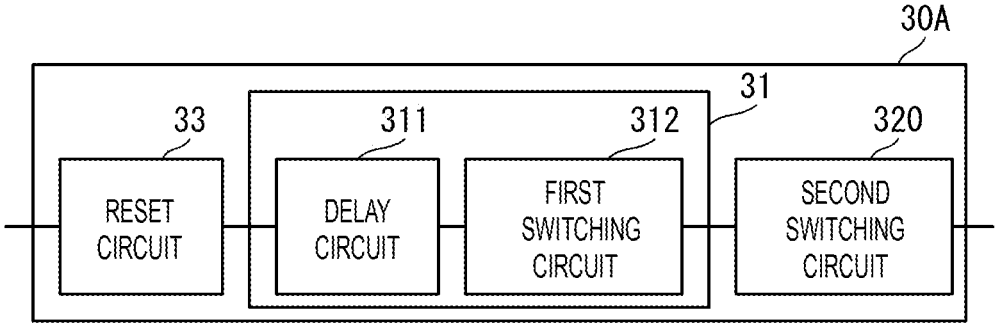
FIG. 13A is a functional block illustrating an aspect of a drive control unit 30A.
Figure 13B:
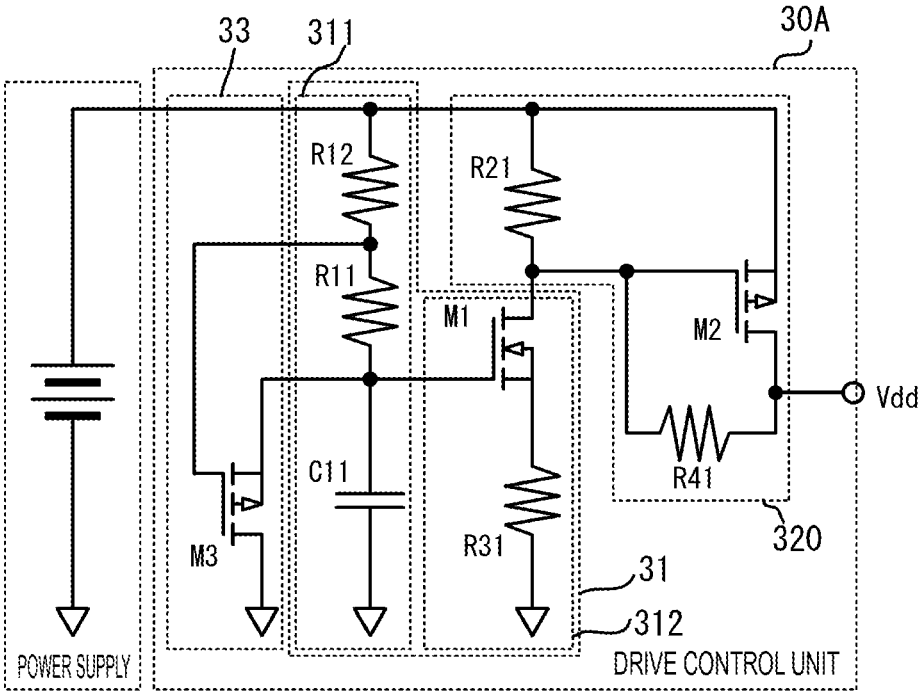
FIG. 13B is a circuit diagram of the drive control unit 30A.

FIG. 13A is a functional block illustrating an aspect of a drive control unit 30A, and FIG. 13B is a circuit diagram of the drive control unit 30A. The drive control unit 30A illustrated in FIGS. 13A and 13B is different from the drive control unit 30 illustrated in FIGS. 12A and 12B in that a reset circuit 33 is added. Except for this, the drive control unit 30A is similar to the drive control unit 30, and description of similar parts is omitted.

The reset circuit 33 initializes operation of the delay circuit 311 and subsequent circuits.

In a case where the drive control unit 30A including the reset circuit 33 is realized by an analog circuit, the drive control unit 30A has, for example, a configuration obtained by adding an FET M3 and a resistive element R12 to the circuit configuration of the drive control unit 30 illustrated in FIG. 12B, as illustrated in FIG. 13B. As illustrated in FIG. 13B, the diode D11 is omitted in the drive control unit 30A.

The FET M3 is a p-type FET. A gate of the FET M3 is connected to the resistive element R11 and the resistive element R12. A source of the FET M3 is connected to the first terminal of the capacitor C11. A drain of the FET M3 is connected to the reference potential.

According to this configuration, in a case where the power supply is on, a voltage of the gate relative to the source of the FET M3 is a positive value (0 V or more). In this state, the FET M3 is in an opened state, and the drain and the source of the FET M3 are not conductive with each other.

Then, when the power supply becomes off in a state where the capacitor C11 is charged, the voltage of the gate relative to the source of the FET M3 becomes a negative value (less than 0 V). In this state, the FET M3 is in a conductive state, and the drain and the source of the FET M3 are conductive with each other. This discharges the capacitor C11 through the FET M3. As a result, the drive control unit 30A is reset to an initial state (a state at the start of supply of the driving power-supply voltage in which the capacitor C11 is not charged).

As described above, in the drive control unit 30A, the reset circuit 33 is realized by the FET M3. According to this configuration, the reset circuit can be realized by using only the single FET M3 and the single resistive element R12, the drive control unit 30A can be realized by a simple configuration. The resistive element R12 is an element for defining a rated voltage of the FET M3 and can be omitted depending on a relationship with the voltage of the power supply.

Figure 14A:
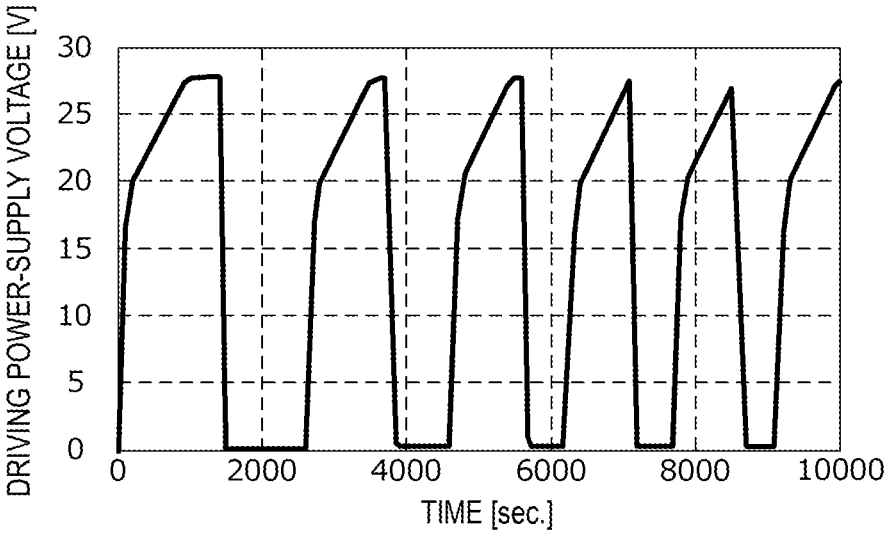
FIG. 14A is a graph illustrating a waveform of the driving power-supply voltage in a case where a reset circuit 33 is used.
Figure 14B:
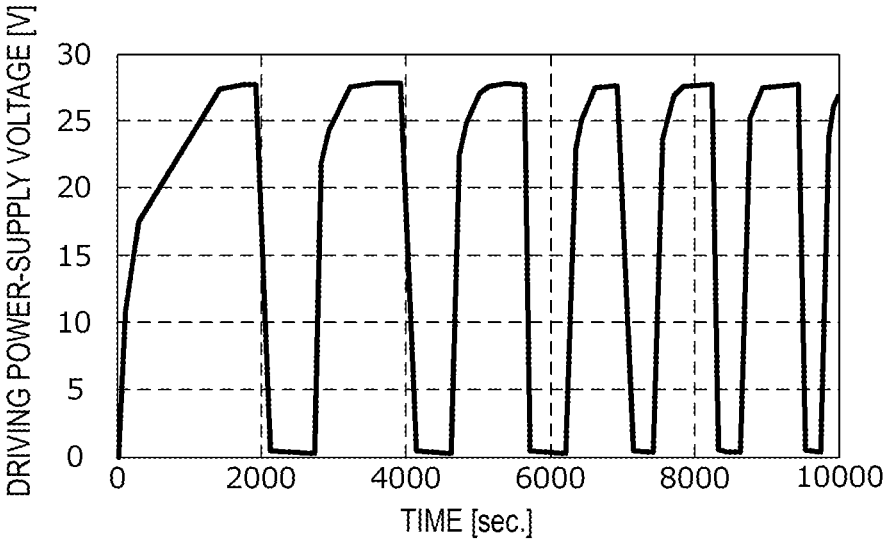
FIG. 14B is a graph illustrating a change of the driving power-supply voltage over passage of time in a case where a reset circuit is not used.

FIG. 14A is a graph illustrating a waveform of the driving power-supply voltage in a case where the reset circuit 33 is used, and FIG. 14B is a graph illustrating a change of the driving power-supply voltage with passage of time in a case where the reset circuit 33 is not used. In FIGS. 14A and 14B, the horizontal axis represents a time, and the vertical axis represents a driving power-supply voltage value.

As illustrated in FIG. 14A, in the configuration in which the reset circuit 33 is used, a rising waveform of the driving power-supply voltage hardly changes even in a case where activating processing is performed repeatedly.

Meanwhile, as illustrated in FIG. 14B, in the configuration in which the reset circuit 33 is not used, the driving power-supply voltage has a rising waveform such that a period in which the voltage rises gradually becomes shorter.

The reset circuit 33 allows the processing for gradually increasing the driving power-supply voltage to be executed repeatedly with certainty. Accordingly, even in a case where activation is repeatedly performed, occurrence of the above problem can be suppressed at each activation.

Note that the circuit for continuously decreasing the driving power-supply voltage as illustrated in FIG. 10A can be realized by employing FIGS. 12A and 13A as appropriate.

Specific Example 3 of Circuit Configuration

The control for increasing the driving power-supply reduced voltage in a stepwise fashion as illustrated in FIG. 8B can be realized, for example, by a circuit configuration described below.

Figure 15:
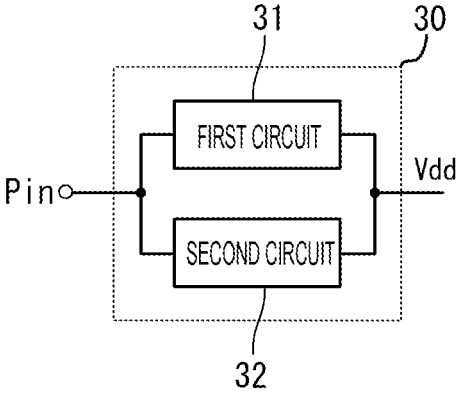
FIG. 15 is a block diagram illustrating a configuration of the drive control unit 30.

FIG. 15 is a block diagram illustrating a configuration of the drive control unit 30.

The drive control unit 30 has a first circuit 31 that constitutes a first path and a second circuit 32 that constitutes a second path. The first circuit 31 and the second circuit 32 are connected in parallel.

The first circuit 31 becomes conductive over a first period after application of a power-supply voltage to a power-supply voltage input unit and becomes conductive over a second period that follows the first period. The second circuit 32 is not conductive over the first period and is conductive over the second period.

According to this configuration, the first path to which the driving power-supply voltage during the first period and the second path to which the driving power-supply voltage is applied during the second period are isolated from each other. This simplifies the circuit configuration.

Figure 16:
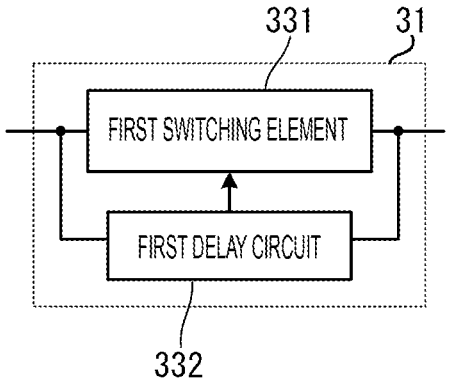
FIG. 16 is a block diagram illustrating a configuration of a first circuit 31.

FIG. 16 is a block diagram illustrating a configuration of the first circuit 31.

The first circuit 31 includes a first switch element 331 and a first delay circuit 332. The first switch element 331 applies the driving power-supply voltage to the driving circuit 20. According to this configuration in which the first delay circuit 332 makes the first switch element 331 conductive for the first period after application of the driving power-supply voltage, the configuration of the first circuit 31 is simplified.

Figure 17:
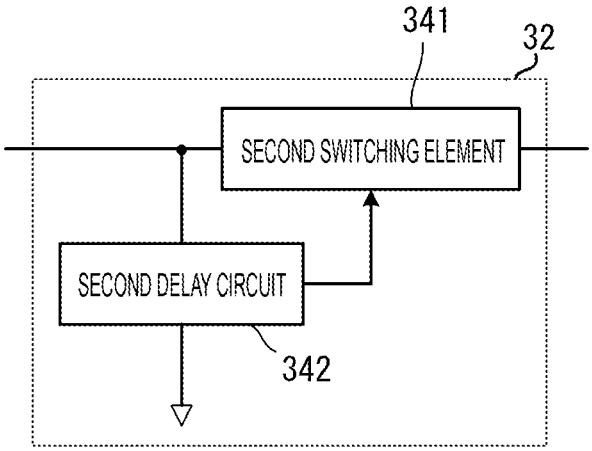
FIG. 17 is a block diagram illustrating a configuration of a second circuit 32.

FIG. 17 is a block diagram illustrating a configuration of the second circuit 32.

The second circuit 32 includes a second switch element 341 and a second delay circuit 342. The second switch element 341 applies the driving power-supply voltage to the driving circuit 20. The second delay circuit 342 makes the second switch element 341 conductive at an end of the first stage. A timing at which the first period in which a low voltage is output switches to the second stage in which a rated voltage is output is decided by a delay time of the second delay circuit 342.

Figure 18:
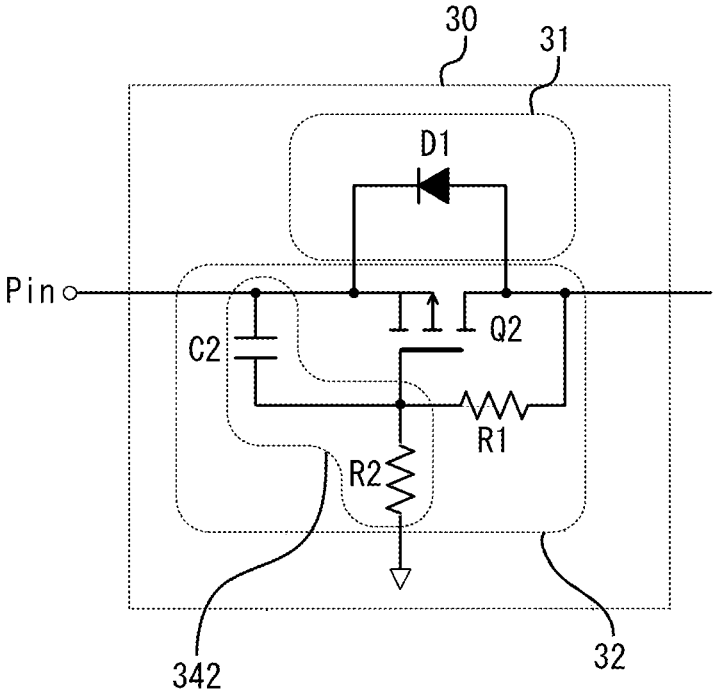
FIG. 18 is a circuit diagram illustrating a specific circuit configuration of the drive control unit 30.

FIG. 18 is a circuit diagram illustrating a specific circuit configuration of the drive control unit 30. In the drive control unit 30 illustrated in FIG. 18, the circuits of FIGS. 15, 16, and 17 are realized by an analog circuit.

As illustrated in FIG. 18, the first circuit 31 is constituted by a diode D1.

The second circuit 32 is constituted by a second MOS-FET Q2, which is a P-channel MOS-FET, a capacitor C2, a resistive element R2, and a resistive element R1. The capacitor C2 and the resistive element R2 constitute the second delay circuit 342, which is a CR time constant circuit. The second MOS-FET Q2 is a depression-type P-channel MOS-FET.

The resistive element R1 constitutes a path for discharging the capacitor C2 while the second MOS-FET Q2 is on. Accordingly, the second delay circuit 342 correctly performs delaying operation even in a case where the power-supply voltage is intermittently input to the power-supply voltage input unit Pin in a short time.

In this example, when the power-supply voltage is applied to the power-supply voltage input unit Pin, first, a reverse current (Zener current) flows through the diode D1. Immediately after the power-supply voltage is applied to the power-supply voltage input unit Pin, the second MOS-FET Q2 keeps an off state since a potential difference between the gate and the source of the second MOS-FET Q2 is small. This realizes a low voltage in the first period.

Then, a gate potential of the second MOS-FET Q2 decreases in accordance with charging of the capacitor C2. When the gate potential of the second MOS-FET Q2 becomes lower than a threshold value, the second MOS-FET Q2 turns on. Since the drain-source voltage in the on-state of the second MOS-FET Q2 is lower than a Zener voltage of the diode D1, an anode-cathode voltage of the diode D1 becomes lower than the Zener voltage due to the turning-on of the second MOS-FET Q2. That is, the diode D1 turns off. This realizes a rated voltage in the second period.

Note that the circuit for decreasing the driving power-supply voltage in a stepwise fashion as illustrated in FIG. 10B can be realized by employing FIGS. 15, 16, 17, and 18 as appropriate.

Figure 19:
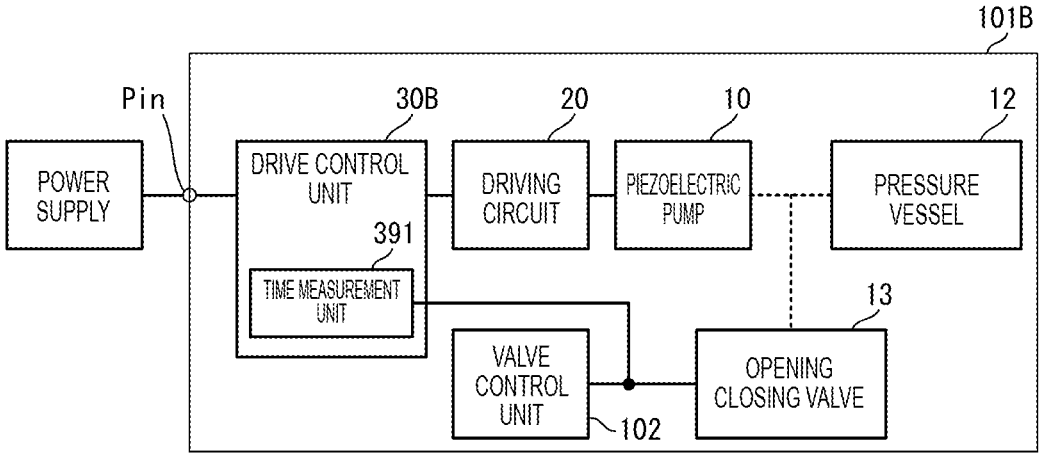
FIG. 19 is a functional block diagram illustrating a configuration of an aspect of a fluid control apparatus 101B according to an embodiment of the present disclosure.

Although, for example, a specific method for measuring an elapsed period is not described above, for example, the circuit configuration illustrated in FIG. 19 may be used.

FIG. 19 is a functional block diagram illustrating a configuration of an aspect of a fluid control apparatus 101B according to an embodiment of the present disclosure. The fluid control apparatus 101B illustrated in FIG. 19 is different from the fluid control apparatus 101 illustrated in FIG. 1A in terms of a drive control unit 30B and a valve control unit 102 (e.g., a controller or the like). Except for this, the fluid control apparatus 101B is similar to the fluid control apparatus 101, and description of similar parts is omitted.

The drive control unit 30B includes a time measuring unit 391. Note that the drive control unit 30 and the drive control unit 30A described above also include a time measuring unit (not illustrated) in a case where an elapsed period is used.

The valve control unit 102 is connected to the opening closing valve 13. The valve control unit 102 controls the opening closing valve 13 to open and close. The valve control unit 102 supplies a control signal to the time measuring unit 391 (e.g., a timer).

The time measuring unit 391 executes time measurement in synchronization with the control signal supplied from the valve control unit 102. The drive control unit 30B executes control of the driving power-supply voltage in synchronization with the control signal.

Specifically, upon receipt of a control signal for closing control, the drive control unit 30B starts control for outputting the driving power-supply voltage in synchronization with this control signal. Concurrently, upon receipt of the control signal for closing control, the time measuring unit 391 starts measurement of an elapsed period in synchronization with this control signal.

Furthermore, upon receipt of a control signal for opening control, the drive control unit 30B stops the control for outputting the driving power-supply voltage in synchronization with this control signal. Concurrently, upon receipt of the control signal for opening control, the time measuring unit 391 finishes the measurement of the elapsed period and resets the elapsed period in synchronization with this control signal.

According to such a configuration, the drive control unit 30B can adjust the driving power-supply voltage and output the driving power-supply voltage to the piezoelectric pump 10 in more precise synchronization with control of the opening closing valve 13.

Figure 20:
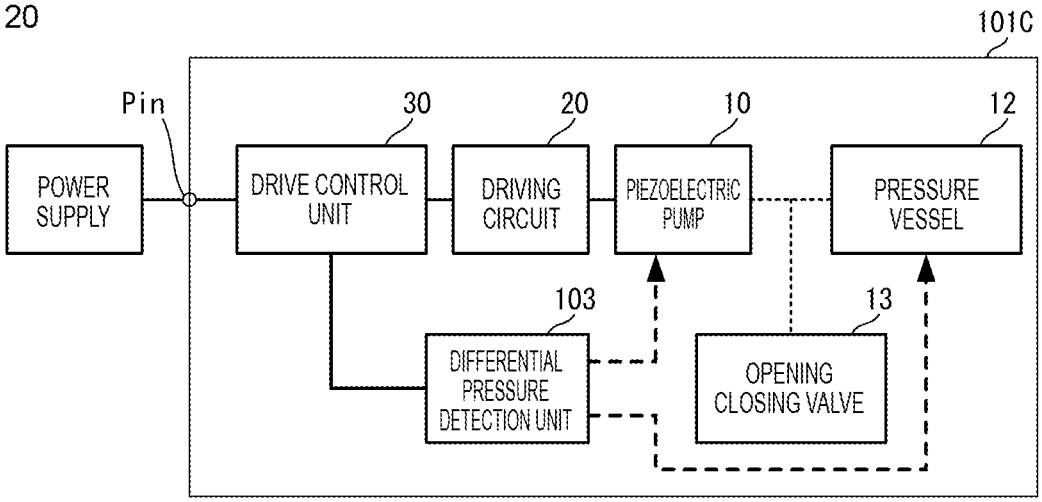
FIG. 20 is a functional block diagram illustrating a configuration of an aspect of a fluid control apparatus 101C according to an embodiment of the present disclosure.

The fluid control apparatus may have the following configuration. FIG. 20 is a functional block diagram illustrating a configuration of an aspect of a fluid control apparatus 101C according to an embodiment of the present disclosure. As illustrated in FIG. 20, the fluid control apparatus 101C is different from the fluid control apparatus 101 illustrated in FIG. 1A in that a differential pressure detection unit 103 (e.g., a sensor) is added. Except for this, the fluid control apparatus 101C is similar to the fluid control apparatus 101, and description of similar parts is omitted.

The differential pressure detection unit 103 detects an inlet-side pressure of the piezoelectric pump 10 and an outlet-side pressure of the piezoelectric pump 10 (an internal pressure of the pressure vessel 12). The differential pressure detection unit 103 calculates a differential pressure between the inlet-side pressure of the piezoelectric pump 10 and the outlet-side pressure of the piezoelectric pump 10. The differential pressure detection unit 103 outputs the differential pressure to the drive control unit 30. The differential pressure detection unit 103 executes the detection of pressures of the parts, the calculation of the differential pressure, and the output of the differential pressure at preset time intervals.

The drive control unit 30 executes control of the driving power-supply voltage by using the acquired differential pressure.

According to such a configuration, the drive control unit 30 can adjust the driving power-supply voltage and supply the driving power-supply voltage to the piezoelectric pump 10 in more precise conformity with the differential pressure.

The drive control unit 30 and the drive control unit 30B may include a step-up circuit, a step-down circuit, or a step-up/down circuit and a micro control unit (MCU) that controls output of the step-up circuit, the step-down circuit, or the step-up/down circuit.

The configuration of the fluid control apparatus illustrated in FIGS. 19 and 20 is also applicable to the fluid control apparatus 101A illustrated in FIG. 1B.

Although an aspect in which the driving power-supply voltage is controlled and adjusted has been described above, a driving current or driving power corresponding to the driving power-supply voltage may be controlled and adjusted.

Although an aspect in which the pressure vessel 12 is pressurized by the piezoelectric pump 10 has been described above, the above description is also applicable to an aspect in which the pressure vessel 12 is depressurized by the piezoelectric pump 10.

Figure 21:
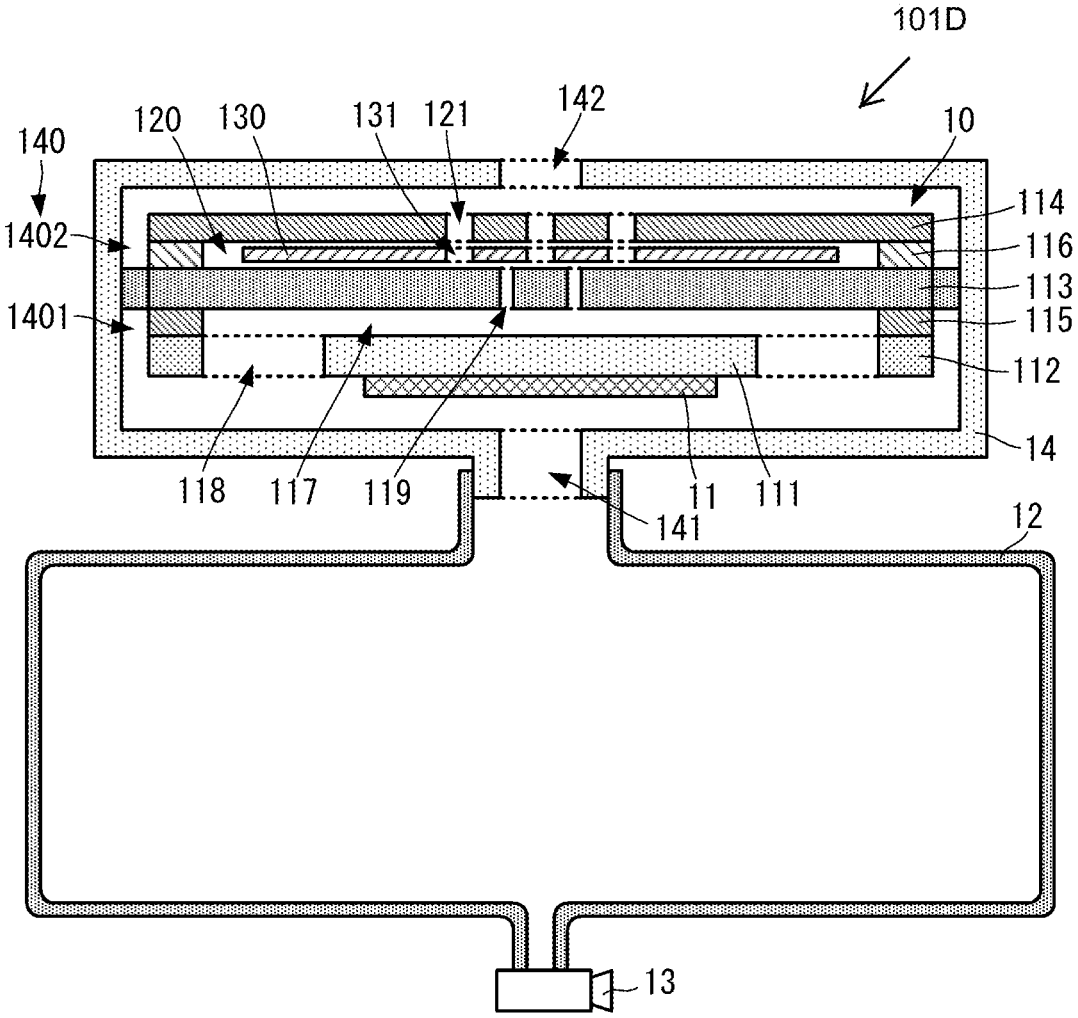
FIG. 21 is a side cross-sectional view illustrating a way in which the piezoelectric pump 10, the pressure vessel 12, and the opening closing valve 13 are connected in an aspect in which the piezoelectric pump 10 is used for depressurization.

In this case, for example, the fluid control apparatus may have the following configuration. FIG. 21 is a side cross-sectional view illustrating a way in which the piezoelectric pump 10, the pressure vessel 12, and the opening closing valve 13 are connected in an aspect in which the piezoelectric pump 10 is used for depressurization.

As illustrated in FIG. 21, a fluid control apparatus 101D includes the piezoelectric pump 10, the pressure vessel 12, the opening closing valve 13, and a housing 14. The housing 14 has an internal space 140 and has an inlet 141 and an outlet 142. The piezoelectric pump 10 is disposed in the internal space 140 of the housing 14. The piezoelectric pump 10 is disposed to separate the internal space 140 into a first space 1401 and a second space 1402. The first space 1401 is communicated with the inlet 141, and the second space 1402 is communicated with the outlet 142. The piezoelectric pump 10 is configured such that the gap 118 is communicated with the first space 1401 and the through-hole 121 is communicated with the second space 1402.

The pressure vessel 12 is disposed so as to cover the inlet 141, and the internal space 140 of the pressure vessel 12 and the inlet 141 are communicated with each other. The opening closing valve 13 is attached to a hole different from a communication hole of the pressure vessel 12 leading to the inlet 141.

Even in such an aspect in which the pressure vessel 12 is depressurized, it is possible to produce effects similar to those produced in the aspect in which the pressure vessel 12 is pressurized.

Although an aspect in which a high-side voltage relative to the piezoelectric pump 10 is controlled has been described in the above embodiments, a low-side voltage may be controlled or both of a high-side voltage and a low-side voltage may be controlled.

Figure 22A:
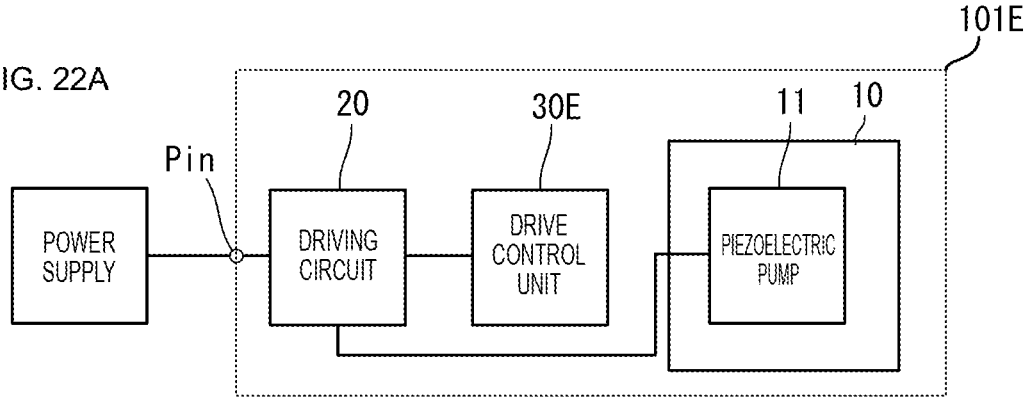
FIG. 22A is a functional block diagram of a fluid control apparatus 101E in a case where a low-side voltage is controlled.
Figure 22B:
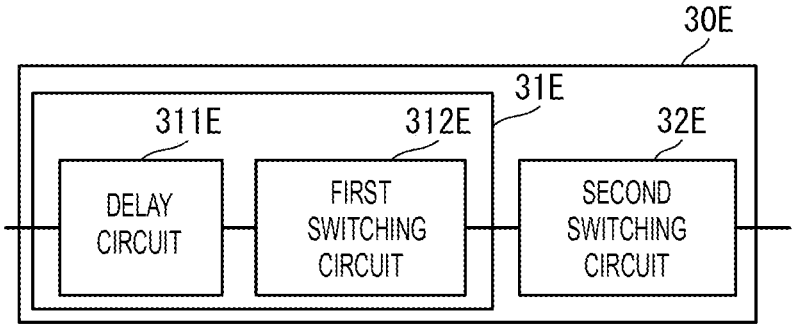
FIG. 22B is a functional block diagram of the driving circuit 20 illustrated in FIG. 22A.
Figure 22C:
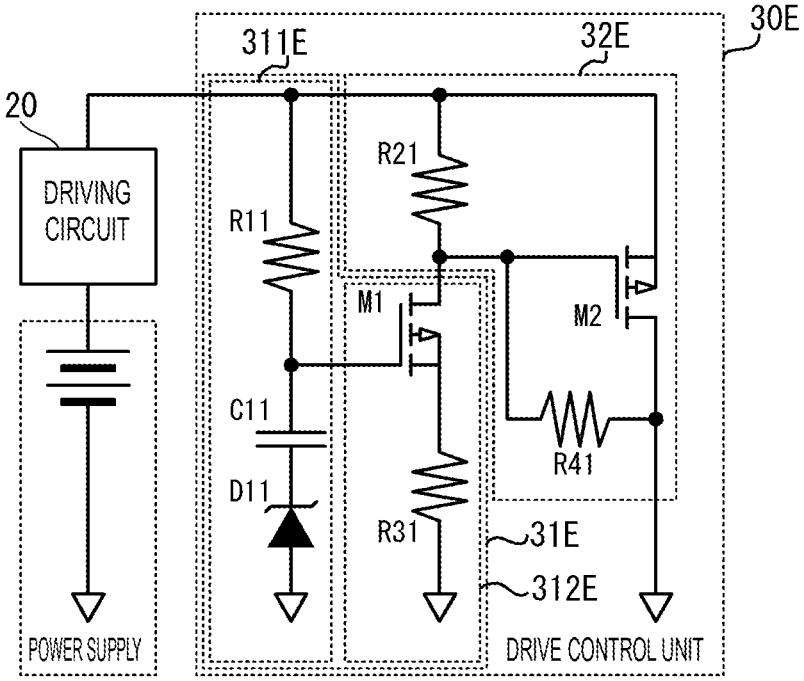
FIG. 22C is a circuit diagram illustrating an example of the driving circuit 20.

FIG. 22A is a functional block diagram of a fluid control apparatus 101E in a case where a low-side voltage is controlled, FIG. 22B is a functional block diagram of a start-up circuit illustrated in FIG. 22A, and FIG. 22C is a circuit diagram illustrating an example of the start-up circuit.

As illustrated in FIG. 22A, the fluid control apparatus 101E includes the piezoelectric pump 10, the driving circuit 20, and a drive control unit 30E. The drive control unit 30E includes a delay circuit 311E, a first switching circuit 312E, and a second switching circuit 32E. The delay circuit 311E and the first switching circuit 312E constitute a first circuit 31E.

As illustrated in FIG. 22A, in the fluid control apparatus 101E, the driving circuit 20 is connected between the power supply (power-supply voltage input unit Pin) and the drive control unit 30E. Except for this, the fluid control apparatus 101E is similar to the fluid control apparatus 101C including the drive control unit 30 illustrated in FIG. 20, and description of similar parts is omitted.

In this case, as illustrated in FIG. 22C, the driving circuit 20 is connected to a positive side of the power supply, and the resistive element R11 of the drive control unit 30E is connected to a side of the driving circuit 20 opposite to a connection terminal for connection with the power supply. A drain of the FET M2 of the drive control unit 30E is connected to a reference potential.

The pressure vessel 12 described in the above embodiments is not limited to the one having a hermetic space and the opening closing valve 13 and can be, for example, one (e.g., gauze used for NPWT) whose pressure changes upon receipt of fluid from the piezoelectric pump 10.

Although the gap 118 is an inlet and the through-hole 121 is an outlet in the above embodiments, the gap 118 may be an outlet and the through-hole 121 may be an inlet by causing the through-hole 131 to overlap the through-hole 119 and not to overlap the through-hole 121. This also produce similar effects.

Finally, the above embodiments are illustrative in every respect and are not restrictive and can be modified and changed as appropriate by a person skilled in the art. The scope of the present disclosure is indicated not by the above embodiments but by the claims. Furthermore, changes from the embodiments within the range of equivalence of the claims are encompassed within the scope of the present disclosure.

REFERENCE SIGNS LIST

10 piezoelectric pump
11 piezoelectric element
12 pressure vessel
13 opening closing valve
20 driving circuit
30,30A,30B,30E drive control unit
31,31E first circuit
32,32E second circuit
33 reset circuit
101,101A,101B,101C,101D,101E fluid control apparatus
102 valve control unit
103 differential pressure detection unit
111 vibration plate
112 support
113 top plate
114 outer plate
115,116 frame
117 pump chamber
118 gap
119 through-hole
120 valve chamber
121 through-hole

130 valve diaphragm
131 through-hole
140 internal space
141 inlet
142 outlet
1401 first space
1402 second space
311,311E delay circuit
312,312E first switching circuit
32,32E second switching circuit
331 first switch element
332 first delay circuit
341 second switch element
342 second delay circuit
391 time measuring unit
C11,C2 capacitor
D1,D11 diode
M1,M2,M3,Q2 FET
R1,R11,R2,R21,R31,R41 resistive element
Pin power-supply voltage input unit

The invention claimed is:

1. A fluid control apparatus comprising:

a piezoelectric pump comprising:

a pump chamber whose volume fluctuates due to displacement of a piezoelectric element, a valve chamber that is in fluid communication with the pump chamber and that comprises a valve diaphragm, a pump chamber opening configured to permit fluid communication between the pump chamber and an outside of the pump chamber, and a valve chamber opening configured to permit fluid communication between the valve chamber and an outside of the valve chamber;

a pressure vessel located outside the valve chamber and in fluid communication with the valve chamber through the valve chamber opening;

an input configured to receive a power-supply voltage from a power supply;

a drive controller configured to control generation of a driving power-supply voltage from the power-supply voltage, and to output the driving power-supply voltage; and a driving circuit configured to drive the piezoelectric element upon application of the driving power-supply voltage from the drive controller, wherein the drive controller is configured to adjust the driving power-supply voltage or a driving current corresponding to the driving power-supply voltage based on collisions of the valve diaphragm with a wall of the valve chamber.

2. The fluid control apparatus according to claim 1, wherein the drive controller is further configured to adjust the driving power-supply voltage or the driving current in accordance with a differential pressure between an atmospheric pressure and a pressure of the pressure vessel.

3. The fluid control apparatus according to claim 2, wherein the drive controller is further configured to increase the driving power-supply voltage or the driving current in accordance with an increase of the differential pressure.

4. The fluid control apparatus according to claim 3, wherein the drive controller is further configured to continuously increase the driving power-supply voltage or the driving current.

5. The fluid control apparatus according to claim 3, wherein the drive controller is further configured to increase the driving power-supply voltage or the driving current in a stepwise fashion.

6. The fluid control apparatus according to claim 3, wherein the drive controller is further configured to increase the driving power-supply voltage only once during a continuous driving period.

7. The fluid control apparatus according to claim 3, wherein the drive controller is further configured to control the driving power-supply voltage or the driving current such that the driving power-supply voltage or the driving current at a first differential pressure is greater than the driving power-supply voltage or the driving current at a minimum value of the differential pressure.

8. The fluid control apparatus according to claim 7, wherein a difference between the minimum value of the differential pressure and the first differential pressure is 0.5 times as large as a difference between the minimum value of the differential pressure and a maximum value of the differential pressure.

9. The fluid control apparatus according to claim 2, wherein the drive controller is further configured to decrease the driving power-supply voltage or the driving current in accordance with an increase of the differential pressure.

10. The fluid control apparatus according to claim 9, wherein the drive controller is further configured to continuously decrease the driving power-supply voltage or the driving current.

11. The fluid control apparatus according to claim 9, wherein the drive controller is further configured to decrease the driving power-supply voltage or the driving current in a stepwise fashion.

12. The fluid control apparatus according to claim 9, wherein the drive controller is further configured to decrease the driving power-supply voltage only once during a continuous driving period.

13. The fluid control apparatus according to claim 9, wherein the drive controller is further configured to control the driving power-supply voltage or the driving current such that the driving power-supply voltage or the driving current at a maximum value of the differential pressure is less than the driving power-supply voltage or the driving current at a predetermined first differential pressure, the predetermined first differential pressure being less than the maximum value of the differential pressure.

14. The fluid control apparatus according to claim 13, wherein the predetermined first differential pressure is an average of a minimum value of the differential pressure and the maximum value of the differential pressure.

15. The fluid control apparatus according to claim 2, wherein the drive controller is further configured to increase the driving power-supply voltage or the driving current in accordance with an increase of the differential pressure, and then decrease the driving power-supply voltage or the driving current in accordance with the subsequent increase of the differential pressure.

16. The fluid control apparatus according to claim 1, further comprising:

an opening-closing valve configured to adjust a pressure of the pressure vessel; and a valve controller configured to control an opening and a closing of the opening-closing valve, wherein the drive controller is further configured to adjust the driving power-supply voltage or the driving current corresponding to the driving power-supply voltage in accordance with an elapsed period of time from when the opening-closing valve begins to close.

17. The fluid control apparatus according to claim 16, wherein the drive controller is further configured to first increase the driving power-supply voltage or the driving current in accordance with the elapsed period of time, and then to decrease the driving power-supply voltage or the driving current in accordance with the elapsed period of time.

18. The fluid control apparatus according to claim 2, further comprising a differential pressure sensor configured to detect the differential pressure, wherein the drive controller is configured to adjust the driving power-supply voltage or the driving current based on the differential pressure detected by the differential pressure sensor.

19. The fluid control apparatus according to claim 16, wherein:

the drive controller comprises a timer; and the timer is configured to measure the elapsed period of time in synchronization with the control for opening and closing the opening-closing valve by the valve controller.

* * * * *